US007587161B2

(12) United States Patent
Yamada et al.

(10) Patent No.: US 7,587,161 B2
(45) Date of Patent: Sep. 8, 2009

(54) FIXER AND IMAGE FORMING APPARATUS

(75) Inventors: Hiroshi Yamada, Numazu (JP); Junichi Awamura, Numazu (JP); Tomomi Suzuki, Numazu (JP); Hiroto Higuchi, Machida (JP); Naohito Shimota, Numazu (JP); Masami Tomita, Numazu (JP); Fumihiro Sasaki, Fuji (JP); Toshiki Nanya, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 119 days.

(21) Appl. No.: 11/194,589

(22) Filed: Aug. 2, 2005

(65) Prior Publication Data

US 2006/0024097 A1 Feb. 2, 2006

(30) Foreign Application Priority Data

| | | |
|---|---|---|
| Aug. 2, 2004 | (JP) | 2004-226198 |
| Sep. 17, 2004 | (JP) | 2004-271385 |
| Sep. 17, 2004 | (JP) | 2004-272161 |
| Sep. 17, 2004 | (JP) | 2004-272595 |

(51) Int. Cl.
*G03G 15/20* (2006.01)

(52) U.S. Cl. ..... 399/327; 399/328; 399/329

(58) Field of Classification Search ..... 399/327, 399/328, 329

See application file for complete search history.

(56) References Cited

U.S. PATENT DOCUMENTS

| | | | | |
|---|---|---|---|---|
| 4,579,802 | A | 4/1986 | Kishi et al. | |
| 5,500,318 | A * | 3/1996 | Tanikawa et al. | 430/124.31 |
| 6,243,558 | B1 * | 6/2001 | Oota | 399/327 |
| 6,531,254 | B1 * | 3/2003 | Bedells et al. | 430/109.3 |
| 2003/0152859 | A1 * | 8/2003 | Emoto et al. | 430/109.4 |
| 2004/0057761 | A1 * | 3/2004 | Ito | 399/349 |
| 2004/0142265 | A1 * | 7/2004 | Tomita et al. | 430/108.4 |
| 2004/0229148 | A1 * | 11/2004 | Kadota et al. | 430/111.4 |
| 2009/0061345 | A1 | 3/2009 | Yamada et al. | |

FOREIGN PATENT DOCUMENTS

| | | |
|---|---|---|
| JP | 05-053372 | 3/1993 |
| JP | 05-107803 | 4/1993 |
| JP | 05-289399 | 11/1993 |

(Continued)

OTHER PUBLICATIONS

U.S. Appl. No. 11/058,278, filed Feb. 16, 2005, Yamada, et al.

(Continued)

*Primary Examiner*—David M Gray
*Assistant Examiner*—Ryan D Walsh
(74) *Attorney, Agent, or Firm*—Oblon, Spivak, McClelland, Maier & Neustadt, P.C.

(57) ABSTRACT

A fixer fixing a toner including a binder resin and a colorant on a recording medium upon application of at least one of heat and pressure, including:

a fixing member fixing the toner on the recording medium;

a pressurizing member pressurizing the toner thereon; and a cleaning member collecting the toner from the fixing member or the pressurizing member onto the cleaning member, wherein a storage modulus of the toner collected on the cleaning member is larger than a storage modulus thereof before fixed.

31 Claims, 5 Drawing Sheets

FOREIGN PATENT DOCUMENTS

| | | |
|---|---|---|
| JP | 05-297630 | 11/1993 |
| JP | 05-313413 | 11/1993 |
| JP | 06-027733 | 2/1994 |
| JP | 06-075426 | 3/1994 |
| JP | 06-118702 | 4/1994 |
| JP | 09-325550 | 12/1997 |
| JP | 11-149180 | 6/1999 |
| JP | 11-305577 | 11/1999 |
| JP | 2000-292981 | 10/2000 |
| JP | 2002-123119 | 4/2002 |
| JP | 2002-372804 | 12/2002 |

OTHER PUBLICATIONS

U.S. Appl. No. 11/512,385, filed Aug. 30, 2006, Tomita.
U.S. Appl. No. 11/685,872, filed Mar. 14, 2007, Uchinokura, et al.
U.S. Appl. No. 11/687,875, filed Mar. 19, 2007, Kojima, et al.
U.S. Appl. No. 11/687,404, filed Mar. 16, 2007, Seshita, et al.
U.S. Appl. No. 11/685,969, filed Mar. 14, 2007, Uchinokura, et al.
Patent Abstracts of Japan, JP 59-101685, Jun. 12, 1984.
U.S. Appl. No. 11/943,713, filed Nov. 21, 2007, Ishikawa, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 12/040,451, filed Feb. 29, 2008, Saitoh, et al.
U.S. Appl. No. 12/050,502, filed Mar. 18, 2008, Yamada, et al.
U.S. Appl. No. 12/047,807, filed Mar. 13, 2008, Honda, et al.
U.S. Appl. No. 12/260,493, filed Oct. 29, 2008, Sawada, et al.

* cited by examiner

FIXER AND IMAGE FORMING APPARATUS

BACKGROUND OF THE INVENTION

1. Field of the Invention

The present invention relates to a toner for developing electrostatic latent images in electrophotography, electrophotographic recording and electrophotographic printing, and to a fixer and an image forming apparatus using the toner.

2. Discussion of the Background

In electrophotographic image forming methods, a heating method upon application of pressure with a heat roller fixes a toner image on a recording medium by passing the recording medium through the surface of the heat roller, having releasability for the toner, while contacting the toner image thereon upon application of pressure. The method has quite good heat efficiency for fusion bonding the toner image on the recording medium because the toner image and the surface of the heat roller contact each other upon application of pressure, and can quickly fix the toner image thereon.

However, a part of the toner image adheres and transfers to the surface of the heat roller because the melted toner image is contacted thereto upon application of pressure, resulting in an offset problem wherein the adhered and transferred part of the toner image retransfers onto a following recording medium and contaminates the recording medium. The offset problem is largely affected by fixing speed and temperature.

Typically, when the fixing speed is low, the surface of the heat roller has comparatively a low temperature to make a heat quantity applied from the heat roller to the toner constant regardless of the fixing speed.

Particularly, in electrophotographic full-color image forming methods, plural toners are layered on a recording medium, and difference of temperatures between an uppermost layer thereof contacting a heat roller and a lowermost layer thereof contacting a recording medium become large when a fixing speed is high and the surface of the heat roller has a high temperature. The toner of the uppermost layer tends to have a hot offset problem. On the contrary, when the heat roller has a low temperature to prevent the hot offset problem, the toner of the lowermost layer is not fully melted, resulting in a cold offset problem wherein the toner is not fixed on the recording medium and adheres to the heat roller.

Recently, a toner having a wide range of fixable temperature, usable even when the fixing speed is high or low, and good offset resistance is required.

On the other hand, high-definition images having good thin line reproducibility are demanded. Therefore, a toner has a smaller particle diameter to increase image resolution and sharpness. However, the toner having a smaller particle diameter has, particularly when the fixing speed is high, low fixability in halftone images. This is because adhered quantity of the toner in halftone images is small, the toner transferred onto a concavity of a recording medium receives less heat quantity from a heat roller, and less pressure because a convexity thereof blocks a pressure to the concavity. In addition, the toner transferred onto the concavity of a halftone image on a recording medium has a thin layer and a pressure applied to a piece of the toner is higher than that of a solid image having a thick toner layer, resulting in occurrence of the offset problems and low-quality fixed images.

In order to make a toner have both fixability and offset resistance, a binder resin therein has been studied so far. Japanese Laid-Open Patent Publication No. 5-107803 discloses a molecular weight distribution of a resin having at least one peak in ranges of $10^3$ to $7\times10^4$ and $10^5$ to $2\times10^6$ respectively when measured by gel permeation chromatography (GPC).

Japanese Laid-Open Patent Publications Nos. 5-289399 and 5-313413 disclose a method of specifying a molecular weight of a vinyl copolymer and including a release agent such as polyethylene to make a toner have both fixability and offset resistance. Japanese Laid-Open Patent Publication No. 5-297630 discloses a method of improving low temperature fixability and hot offset resistance of a toner.

Japanese Laid-Open Patent Publications Nos. 5-053372, 6-027733, 6-075426 and 6-118702 disclose a method of widening a molecular weight of a binder resin, and balancing storage stability, fixability and hot offset resistance of the resultant toner.

Japanese Laid-Open Patent Publication No. 2002-372804 discloses a method of specifying a storage modulus of a toner to have good low-temperature fixability and hot offset resistance.

Conventional electrophotographic image forming apparatus includes a fixer wherein a pressure is pressed against a heating roller including a heat source, and a recording medium on which a toner image is transferred is passed therebetween to fix the The fixer occasionally has an offset problem wherein the toner on the recording medium adheres to the heat roller. The offset toner also adheres to the pressure roller, and contaminates the recording medium when transferred therefrom. In order to prevent the offset, the surface of the heat roller in the conventional fixer has been fluorinated. However, it is difficult to completely prevent the offset due to environmental conditions and sorts of the recording medium.

Some conventional fixers have cleaners such as cleaning rollers removing a toner adhered to heat rollers and pressure rollers while contacting thereto. Such a cleaning member as is formed of a pure metal is pressed against the heat roller and pressure roller having improved surface releasability to remove the toner therefrom using a difference of the surface releasability therebetween.

Recently, image forming apparatuses stop supplying electricity to heat sources in standby states and do not supply electricity thereto until forming an image to heat the heat rollers to have a fixable temperature. Therefore, the temperature responsibility the heat roller needs to be improved, e.g., the heat roller has a thickness of 1 mm to shorten a warmup time to about 10 sec to have a fixable temperature.

In such an image forming apparatus, the heat roller has a small heat capacity and tends to have a nonuniform temperature distribution in the across-the-width direction due to a heat transfer to a recording medium when fixing or a member contacting thereto and a wind flow around the heat roller. In addition, the heat roller cannot have uniform temperature at all areas thereof in terms of space and cost.

When the heat roller has a nonuniform temperature distribution in the across-the-width direction, the fixability thereof becomes unstable and the offset tends to occur, and the heat roller has a shorter life due to heat deterioration. In Japanese Laid-Open Patent Publications Nos. 11-305577, 11-149180 and 2000-292981, an agglomerated polymerized toner adhered and accumulated on a cleaning member is melted again and transferred onto a recording medium to contaminate the recording medium. This is because the polymerized toner having a low storage modulus adheres to the cleaning member while a hard-to-melt pulverized toner having a high storage modulus adheres thereto.

A recording medium having a small size has more of this problem than a recording medium having a maximum passable size. This is because the recording medium having a small size has a small area contacting the heat roller, and a temperature of only the small area decreases and a temperature sensor turns on a heat source to needlessly increase a temperature of an area the recording medium does not pass through, resulting in melting of a toner on a cleaning member cleaning the area the recording medium does not pass through.

Japanese Laid-Open Patent Publication No. 9-325550 discloses a fixer preventing excessive increase of temperature of an area thereof a recording medium does not pass through by blowing a wind thereto to uniform a temperature distribution thereof in the across-the-width direction.

Japanese Laid-Open Patent Publication No. 9-325550 also discloses a fixer having a ventilator along a cleaning roller, circulating air therein with a rotation of the cleaning roller to prevent the cleaning roller from having an excessive high temperature.

Because of these reasons, a need exists for a fixer preventing a toner from melting out therefrom and contaminating images.

SUMMARY OF THE INVENTION

Accordingly, an object of the present invention is to provide a fixer preventing a toner from melting out therefrom and contaminating images, and an image forming apparatus using the fixer and a toner used therein.

Another an object of the present invention is to provide a fixer preventing a toner adhered to a cleaning member from transferring onto a recording medium without decreasing fixability, and an image forming apparatus using the fixer and a toner used therein.

A further object of the present invention is to provide a fixer producing images having high image density and high definition, and an image forming apparatus using the fixer and a toner used therein.

These objects and other objects of the present invention, either individually or collectively, have been satisfied by the discovery of a fixer fixing a toner comprising a binder resin and a colorant on a recording medium upon application of at least one of heat and pressure, comprising:

a fixing member fixing the toner on the recording medium;

a pressurizing member pressurizing the toner thereon; and a cleaning member collecting the toner from the fixing member or the pressurizing member onto the cleaning member, wherein a storage modulus of the toner collected on the cleaning member is larger than a storage modulus thereof before fixed.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a fixer and an image forming apparatus wherein an offset toner in the fixer is collected by a cleaning roller to prevent the toner from melting out without restrictions of design of the toner such as chargeability (an amount of charge controlling agent) and fixability (an amount of low-molecular-weight resin).

Figure 1:
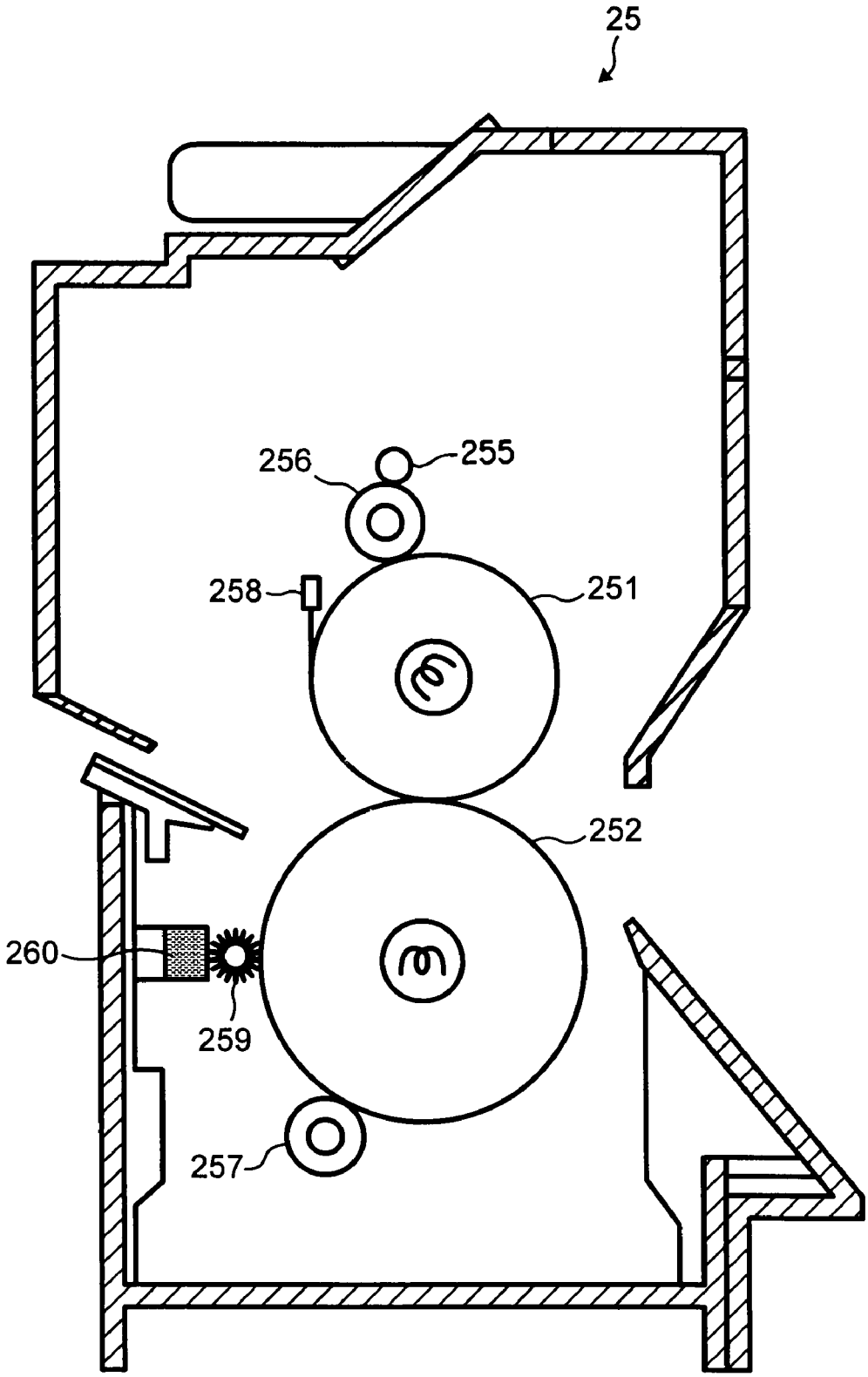
FIG. 1 is a schematic view illustrating an embodiment of the fixer including a heat roller and pressure roller of the present invention.

FIG. 1 is a schematic view illustrating an embodiment of the fixer including a heat roller and pressure roller of the present invention.

A fixer 25 of the present invention includes a fixing roller 251 including a metallic shaft formed of metals such as stainless and aluminum; and a ring-shaped elastic layer located overlying the metallic shaft, which is formed of a heat resistant elastic material such as a foamed silicone rubber and a liquid silicone rubber to form a nip with a pressure roller 252. The elastic layer includes a release layer on the surface thereof to improve releasability of a transfer paper and a toner. The release layer is formed of a heat resistant material having a low surface energy such as a silicone resin, a fluorine-containing resin, and polymer resins such as polytetrafluoroethylene (PTFE), a tetrafluoroethylene-perfluroalkylvinylether copolymer (PFA) and a tetrafluroethylene-hexafluoropropylene copolymer (FEP). A heat source such as a halogen heater is located in the metallic shaft of the fixing roller 251 to accelerate increasing a temperature thereof.

The pressure roller 252 includes a metallic shaft formed of metals such as stainless and aluminum; and an elastic layer having a suitable thickness, located overlying the metallic shaft, which is formed of a heat resistant elastic material such as a fluorine-containing rubber and a silicone rubber. The elastic layer includes a release layer formed of a fluorine-containing resin, etc. on the surface thereof as the elastic layer of the fixing roller 251 does. The pressure roller 252 is pressed against the fixing roller 251 by a pressurizer such as a spring (not shown) and the elastic layer is elastically deformed to form a nip pressurizing and heating a toner for a specific time therebetween.

A coating roller 255 coating an oil such as silicone oil on the fixing roller 251 to improve releasability thereof for the offset prevention, and a cleaning roller 256 removing a toner and a paper powder adhered to the fixing roller 251 are located. A cleaning roller 257 is also located removing a toner from the fixing roller 251 and a paper powder, which adhere to the pressure roller 252. Further, a temperature sensor 258 such as a thermistor detecting a temperature of the fixing roller 251 or pressure roller 252 to control a heater therein.

Figure 2:
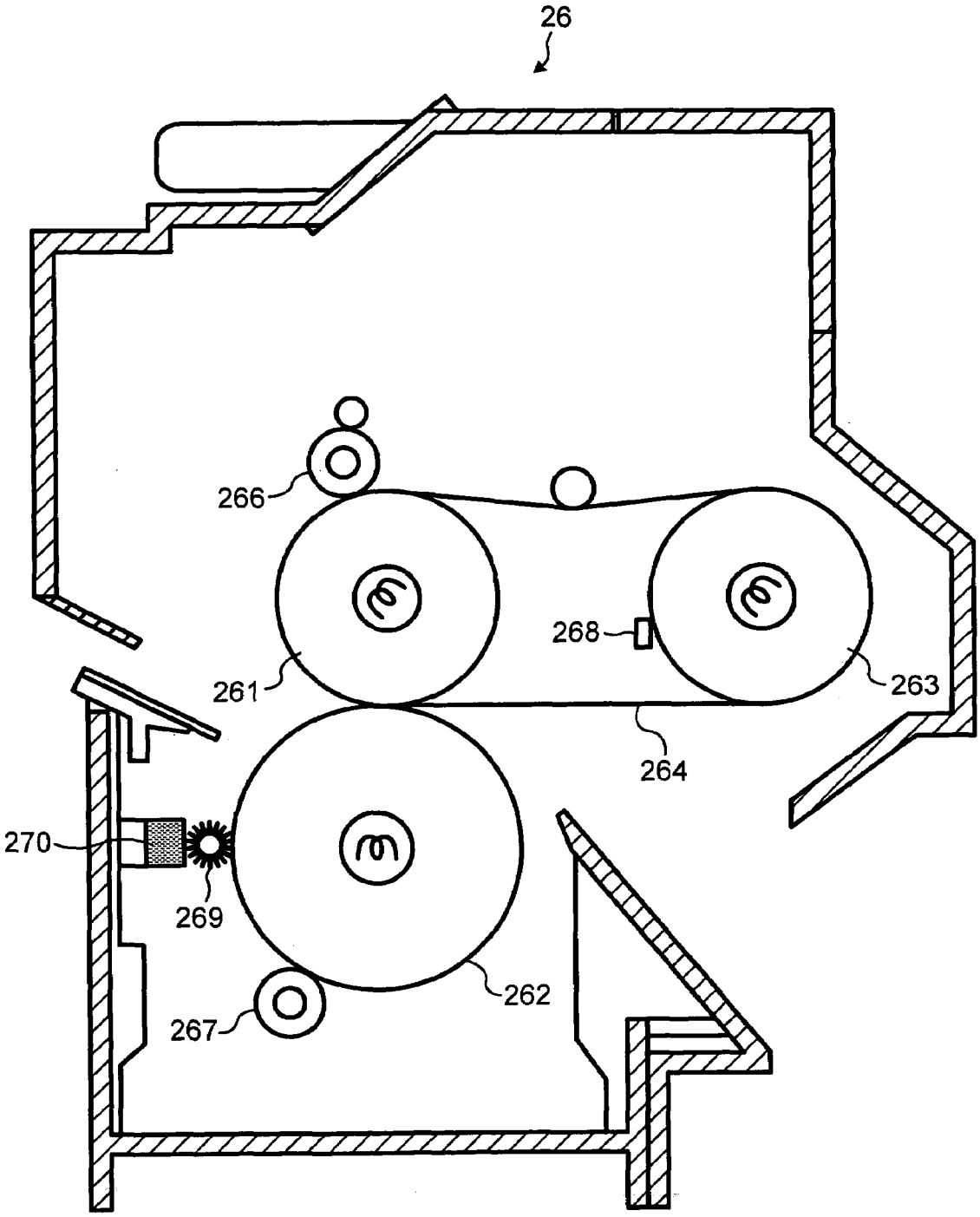
FIG. 2 is a schematic view illustrating an embodiment of the fixer including a fixing belt of the present invention.

FIG. 2 is a schematic view illustrating an embodiment of the fixer including a fixing belt of the present invention. A fixer 26 includes a heat roller 263, a fixing roller 261, a pressure roller 262 pressed against the fixing roller 261 and a fixing belt 264 suspended between the heat roller 263 and the fixing roller 261.

Each of the fixing roller 261 and the pressure roller 262 includes a metallic shaft formed of metals; and an elastic layer having a suitable thickness, located overlying the metallic shaft which is formed of a heat resistant elastic material. The elastic layer includes a release layer formed of a fluorine-containing resin, etc. on the surface thereof as the elastic layer of the fixing roller 251 and the pressure roller 252 do in FIG. 1. Each of the metallic shafts includes a halogen heater. The pressure roller 262 is pressed against the fixing roller 261 by a pressurizer such as a spring (not shown) through the fixing belt 264 and the elastic layer is elastically deformed to form a nip pressurizing and heating a toner for a specific time therebetween.

The fixing belt 264 includes an endless-belt-shaped substrate formed of a heat resistant resin or a metal. The heat resistant resin includes polyimide, polyamideimide, polyether ketone, etc. The metal includes nickel, aluminum, stainless, etc. The resin and the metal may be combined, and particularly a belt formed of a polyimide resin on which nickel is electro formed is preferably used because of having moderate strength, elasticity and durability. The belt preferably has a thickness not greater than 100 μm. Contacting a transfer paper and a toner upon application of pressure, the fixing belt 264 includes an elastic layer formed of a silicone rubber, etc. and a heat resistant release layer formed of a fluorine-containing resin having a low friction coefficient.

The heat roller 263 suspends and heats the fixing belt 264. Therefore, the heat roller 263 includes a heat source such as a halogen lamp and a nichrome wire. The heat roller 263 is a thin-walled roller formed of a hollow metallic cylinder made of aluminum, carbon steel, stainless steel, etc., and a good heat-conductant aluminum cylinder having a thickness of from 1 to 4 mm can have a narrow distribution temperature in the axial direction. Further, the surface of the heat roller 263 is coated with alumite to prevent an abrasion with the fixing belt 264. A temperature sensor 268 formed of a thermocouple, a thermistor, etc. is located along the circumference of the heat roller 263 through the fixing belt 264 to detect a temperature thereof. A temperature controller (not shown) controls operations of the heater in the heat roller 263 according to a signal detected by the temperature sensor 268.

In FIG. 1, a toner on a recording paper receives a heat and a pressure at the nip between the fixing roller 251 and the pressure roller 252 in the fixer 25. Then, the toner melts and the viscosity and elasticity thereof lower. At the same time, the toner expands on the recording paper with the pressure and enters among fibers thereof. Next, the recording paper comes out of the nip and leaves away from the rollers 251 and 252. A low-molecular-weight component having a low viscosity, included in a toner, melts and is liable to penetrate among the fibers of the recording paper, and at the same time, is liable to separate from and adhere to the fixing roller 251, having a low elasticity. A polymer component having a high viscosity and a high elasticity, transfers to the fixing roller 251 when melted and the viscosity (adherence to the fixing roller 251) is larger than the elasticity. When the fixing roller 251 rotates and contacts another recording paper, the transferred toner adheres thereto to contaminate images thereon. To avoid this problem, a cleaning roller is located by the fixing roller 251, a silicone oil is applied thereto or a release agent is included in a toner so as not to remain thereon. However, it is difficult to completely prevent the toner from remaining thereon.

In addition, a part of the toner transfers to the pressure roller 252 having a lower temperature from the fixing roller 251. When the pressure roller 252 rotates and contacts another recording paper, the toner transferred to the pressure roller 252 adheres to a backside thereof to contaminate images thereon. To avoid this problem, a cleaning roller 257 is located by the pressure roller 252. The cleaning roller 257 collects the toner transferred from the fixing roller 251. However, the toner collected on the cleaning roller 257 occasionally melts again with a heat when the fixer 25 starts working and transfers to the pressure roller 252 from the cleaning roller 257 to contaminate a backside of a recording paper at the nip. Particularly, the low-molecular-weight component in a binder resin of a toner is more liable to melt out again than the polymer component therein because the storage modulus of the low-molecular-weight component easily changes with a heat.

The toner adhered to the pressure roller 252 is collected by the cleaning roller 257 at the nip therebetween. Thus, the toner adhered to the fixing roller 251 is collected by the cleaning roller 257, and a few gram of the toner is collected thereby when 150,000 images are produced. Since a conventional toner uses a resin having comparatively a high glass transition temperature of about 60° C. and has a high viscosity when adhered to the cleaning roller 257, the toner is difficult to melt out even when the fixer 25 and the cleaning roller 257 have a high temperature in proportion to the number of produced images. However, a low-molecular-weight resin melting a comparatively a low temperature melts at a temperature lower than a fixable temperature of the toner. Therefore, the toner collected on the cleaning roller 257 melts out therefrom to adhere to the pressure roller 252 or the fixing roller 251 again when rotated without passing a recording paper therebetween. When a recording paper is passed therebetween, the recording paper is contaminated with the toner melted out.

The cleaning roller 257 in the fixer 25 is coated with a reactive material enlarging a storage modulus of a binder resin. Therefore, the toner collected on the cleaning roller 257 does not adhere to the pressure roller 252 or the fixing roller 251 again when rotated without passing a recording paper therebetween. This is because the storage modulus of the toner collected on the cleaning roller is larger than that of the toner before passing through the fixer and is difficult to adhere to the pressure roller 252 even when further heated.

Figure 3:
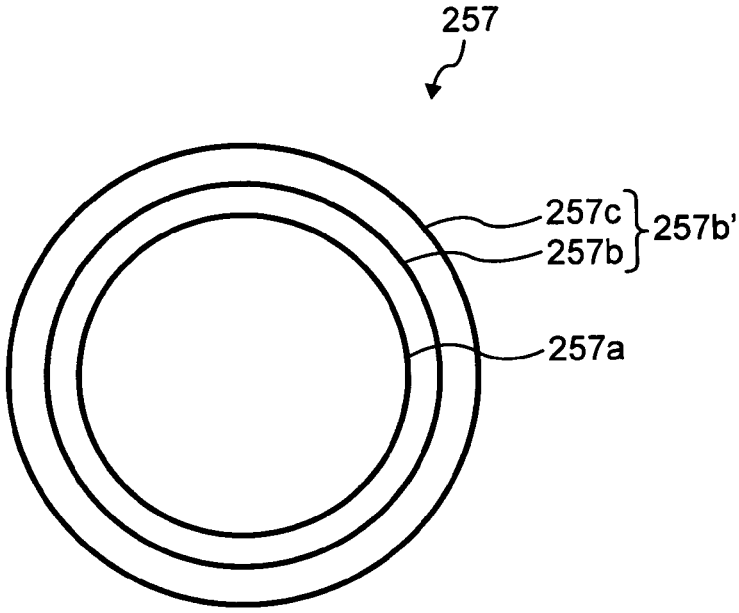
FIG. 3 is a cross-sectional view illustrating an embodiment of a layer composition of the cleaning roller of the present invention.

Further, the cleaning roller 257 in the fixer 25 may have a coated layer including a reactive material enlarging a viscoelasticity of a binder resin in a toner. FIG. 3 is a cross-sectional view illustrating an embodiment of a layer composition of the cleaning roller of the present invention. A coated layer 257*b* includes only the reactive material or the reactive material and a binder resin. The coated layer 257*b* including only the reactive material is fragile against a mechanical stress and is occasionally peeled off from a metallic shaft. To prevent the coated layer 257*b* from being peeled off therefrom, at least a binder resin is preferably included therein.

In the fixer of the present invention, a ratio Dcore (the reactive material/the binder resin) at a contact part of the coated layer 257*b* to the metallic shaft of the cleaning roller 257 and a ratio Dsurface (the reactive material/the binder resin) in the surface thereof satisfy the following relationship:

$$Dcore > Dsurface$$

Even when the toner collected on the cleaning roller 257 is hardened by a crosslinking reaction, the reactive material diffuses from the surface of the shaft 257*a*, having a ratio Dcore, to provide another reacting opportunity. Therefore, it is necessary to satisfy the above-mentioned relationship.

In the fixer 25 of the present invention, the coated layer 257*b* may be plural, e.g., a coated layer 257*b'* includes a first coated layer 257*b* and a second coated layer 257*c* in FIG. 3. The toner collected by the cleaning roller 257 is accumulated as the second coated layer 257*c*, and the coated layer 257*b'* has plural layers having a different content of the reactive material per unit volume respectively, wherein a concentration thereof moderately varies. The toner collected by the cleaning roller 257 react with the reactive material to prevent the toner from melting out therefrom. This is because a binder resin in the toner crosslinked with a reactive material has a higher elastic modulus to prevent the toner from melting out. Further, a content of the reactive material in the first coated layer 257*b* is high, and a content thereof in the second coated layer 257*c* formed by accumulation of the collected toner gradually decreases. When the second coated layer 257*c* has less concentration of the reactive material as the collected toner increases, the reactive material has no more effect and the toner melts toner.

A ratio ($\alpha/\beta$) of a content ($\alpha$) of the reactive material per unit volume in the first coating layer 257*b* to a content ($\beta$) of the reactive material per unit volume in the first coating layer 257*c* is from 1 to 200.

When the ratio ($\alpha/\beta$) is less than 1, the reactive material in the second coated layer 257*c* has a diffusing speed lower than that of the first coating layer 257*b*, and the reactive material has less reacting opportunity with the toner, resulting in difficulty of preventing the toner from melting out. When the ratio ($\alpha/\beta$) is more than 200, the reactive material is less fed to the toner collected on the surface of the second coated layer 257*c*, and also the reactive material has less reacting opportunity with the toner, resulting in difficulty of preventing the toner from melting out.

The collected toner adheres to the surface of the second coated layer 257*c*, and the second coated layer 257*c* gradually grows with the toner. Therefore, the second coated layer 257*c* may not include a fixed content of the reactive material, and may have a gradient thereof in a scope of the ratio ($\alpha/\beta$) of from 1 to 200. Particularly, a border between the binder resin in the toner and the resin in the second coated layer 257*c* gradually becomes undefined and unified when the fixer is used for long periods. The reactive material also diffuses to the binder resin in the toner collected on the surface thereof and enlarges the elastic modulus of the binder resin to prevent the toner from melting out. However, when the ratio ($\alpha/\beta$) is more than 200, the reactive material is fed to the collected toner at a lower speed and in less amount, resulting in difficulty of preventing the toner from melting out. In addition, the second coated layer 257*c* preferably includes the reactive material in an amount not less than 2% by weight. When less than 2% by weight, the collected toner cannot be crosslinked to enlarge the elastic modulus thereof, resulting in difficulty of preventing the toner from melting out.

The first coating layer 257*b* preferably includes the reactive material in an amount of from 0.05 to 1.0 g, and more preferably from 0.1 to 0.3 g. When less than 0.05 g, an amount of the reactive material fed to the second coated layer 257*c* is too small to enlarge the viscoelasticity of the toner, and the resultant cleaning roller has a shorter life. When greater than 1.0 g, the first coating layer 257*b* has a thicker thickness and a total amount of the toner collected on the cleaning roller 257 becomes less, and further, the first coating layer 257*b* becomes hard and has a crack.

The second coated layer 257*c* preferably includes the reactive material in an amount not greater than 10 g. When greater than 10 g, the second coating layer 257*c* has a thicker thickness and diffusing of the reactive material therein from the first coating layer 257*b* takes too long time to prevent the toner from melting out.

As mentioned above, in a small image forming apparatus, the first coating layer 257*b* and the second coated layer 257*c* preferably include a suitable amount of the reactive material respectively.

The reactive material enlarging storage modulus includes a material crosslinking or elongating with a binder resin to enlarge the molecular weight. A material crosslinking with a functional group having a polarity in the binder resin to enlarge the storage modulus is preferably used. The material crosslinking therewith is different from amines and ketones used for crosslinking or elongating with a monomer in a solvent. Specific examples of the reactive material enlarging storage modulus include metallic compounds such as metallic salts of a naphthenic acid or a higher fatty acid; azo metal complexes; salicylic acid metallic salts or zinc salicylate; metal complexes of chrome, iron, zirconium, etc.; and chelate compounds or metal alcoholates of silicon, zirconium or aluminum. These are coated on the cleaning roller 257, crosslinked with a toner collected thereon and enlarge the storage modulus thereof to prevent the toner from melting out again from the cleaning roller 257 and the recording paper from being contaminated.

Specific examples of the coated resin include, but are not limited to, a polyester resin, styrene-alkyl acrylate resins, styrene-alkyl methacrylate resins, styrene-butadiene resins, a styrene-acrylonitrile resin, a polyurethane resin, an epoxy resin, a silicone resin, polyvinylchloride, a polyamide resin, a phenol resin, a xylene resin, etc. The resin preferably includes a functional group reacting with the reactive material at the end. The functional group reacting or interact with the reactive material includes polar groups including a heteroatom, such as a carbonyl group, a urethane group, a urea group, sulfonic acid group, etc. Particularly, a carboxylic acid forming a polyester resin is preferably used. The carboxylic acid is liable to be hydrogen-bonded and interact with the reactive material. In addition, the carboxylic acid can be replaced with other functional groups with comparative ease because of not being so strongly bonded therewith, and diffuses the reactive material well.

Specific examples of solvents for coating the resin include aromatic hydrocarbons such as toluene and xylene; poly (meth)acrylates such as methyl ethyl ketone and alcohols, e.g., methanol, ethanol, propanol, isopropanol, t-butanol, methoxy ethanol, ethoxy ethanol, butoxy ethanol, etc.; nitriles such as acetonitrile; and dioxane, etc. The alcohols are preferably used.

The reactive material and the resin are dissolved and mixed in the solvent to prepare a coating liquid. Specific examples of the coating methods include, but are not limited to, a roller coating method, a scraper coating method, a brush coating method, an air-sprayed coating method, etc.

The first coating layer 257*b* preferably includes the reactive material and the resin in an amount ratio (reactive material/resin) of from 30 to 70% by weight/70 to 30% by weight, and more preferably from 40 to 60% by weight/60 to 40% by weight.

When the reactive material is less than 30% by weight and the resin is more than 70% by weight, an amount of the reactive material is too small to react the toner collected by the cleaning roller 257 and enlarge the viscoelasticity thereof. The thicker coated layer 257*b'* can compensate the amount thereof, but the cleaning roller 257 collect the toner less, resulting in a disadvantage for downsizing image forming apparatus. When the reactive material is more than 70% by weight and the resin is less than 30% by weight, a binding force of the coated layer 257*b'* becomes small and fragile against an external force, and liable to have a crack.

The cleaning roller 257 in the fixer 25 of the present invention is formed of a metal such as copper, e.g, SUS, brass, etc. and aluminum, and has the shape of a roller having a diameter of from 10 to 30 mm. In addition, the cleaning roller 257 has a ten-point mean roughness Rz (hereinafter referred to as "roughness Rz") of from 3 to 50 μm. The surface roughness Rz can be formed by methods such as a shot blast method, a sand blast method and a liquid honing method, and particularly the sand blast method is preferably used because of its easiness. The shape of a roller has a wide area to be used in the circumferential direction, and the cleaning roller 257 has a long life. The cleaning roller 257 preferably has as small a diameter as possible, installable in the fixer. When the cleaning roller 257 has too large a diameter, the fixer 25 has a long warmup time. However, the cleaning roller 257 being large has a large surface area and can collect the toner more. Further the toner collected thereon has a thinner thickness and the thickness varies less, which decreases mechanical pressure and heat quantity to the pressure roller 252, and the resultant fixer has good stability. When the cleaning roller 257 has too small a diameter, the toner collected thereon has a thicker thickness, which increases mechanical pressure and heat quantity to the pressure roller 252, resulting in melting of the toner. A coaling liquid including the reactive material can uniformly be coated on the cleaning roller 257 having a specific roughness Rz. When Rz is small, the coating liquid falls off from the cleaning roller 257. When large, the reactive material cannot uniformly stay thereon. The pressure roller 252 may have plurality of the cleaning rollers 257. The cleaning roller 257 may be in a body with the fixing roller 251 or alone.

The fixer of the present invention includes a pressurizer pressurizing the cleaning roller 257 to the pressure roller 252 or fixing roller 251. The pressurizer may have the shape of a roller or a plate, and is a spring. The cleaning roller 257 is pressurized to the pressure roller 252 with the spring to more efficiently collect the toner adhered thereto.

The pressurizer can be movable to pressurize the cleaning roller 257 to the pressure roller at a fixed pressure even when the cleaning roller 257 has a larger diameter collecting the toner.

The toner of the present invention preferably has (1) a storage modulus of from $5.0\times10^3$ to $5.0\times10^4$ Pa, and more preferably from $1.0\times10^4$ to $2.0\times10^4$ Pa at 120° C. before heated in the fixer, and (2) a storage modulus of from $1.0\times10^3$ to $3.0\times10^4$ Pa, and more preferably from $1.5\times10^3$ to $2.5\times10^3$ Pa at 180° C.

A toner having these storage modulus has good low-temperature fixability and hot offset resistance.

When the storage modulus is less than this range, hot offset resistance of the resultant toner deteriorate. When greater than this range, the low-temperature fixability thereof deteriorates.

As mentioned above, the toner of the present invention preferably includes a metal compound crosslinking or elongating a prepolymer when receiving a heat. The metal compound is an organic metal compound used as a charge controlling agent, i.e., a metal compound of an aromatic carboxylic acid derivative, and particularly a salicylic acid metal compound is preferably used. The metal preferably has two valences or more, and particularly $Al^{3+}$ is preferably used. When a toner includes the metal compound in an amount of 0.5 to 6.0% by weight, the toner has less initial variation of charge quantity and easily has a required absolute charge quantity when developing. Therefore, deterioration of the resultant image quality, such as foggy images and lower image density, can be prevented.

The toner of the present invention preferably has a storage modulus at 120° C. when collected on the cleaning member, of from 1 to $10^2$ times a storage modulus at 120° C. before passing through the fixer. When less than 1 time, the toner adheres again to the pressure roller 252 or the fixing roller 251. When greater than $10^2$ times, the low-temperature fixability of the resultant toner deteriorates.

In addition, the toner of the present invention preferably has a storage modulus at 180° C. when collected on the cleaning member, of from 1 to 10 times a storage modulus at 180° C. before passing through the fixer. When less than 1 time, the toner adheres again to the pressure roller 252 or the fixing roller 251. When greater than 10 times, the low-temperature fixability of the resultant toner deteriorates.

The toner of the present invention used in the fixer 25 preferably has a difference between a storage modulus G'1 thereof at 120° C. before a reactive material is fed to and a storage modulus G'2 thereof at 120° C. after the reactive material is fed to satisfying the following relationship:

$$0<G'2-G'1\leqq10{,}000\ \text{Pa}$$

The heat properties of the toner besides the fixing conditions of the fixer 25 affect melting of the toner. Particularly, the storage modulus thereof largely affects fixing and melting thereof. The larger the storage modulus, the sooner the toner returns to normal even when deformed. Therefore, a large storage modulus can prevent the offset of the toner and can prevent the toner from melting out when collected on the cleaning roller 257. However, when the storage modulus is too large, the fixable minimum temperature thereof deteriorates.

A difference between a storage modulus G'1 of the toner at 120° C. before a reactive material is fed to and a storage modulus G'2 thereof at 120° C. after the reactive material is fed to satisfies the following relationship:

$$0<G'2-G'1$$

The storage modulus G'1 of the toner at 120° C. before a reactive material is fed thereto is preferably from at least 5,000 to 20,000 Pa. In addition, the difference G'2−G'1≦10,000 Pa. The larger the storage modulus G'2 at 120° C. after the reactive material is fed to the toner, the harder the toner. The difference G'2−G'1≦10,000 Pa prevents the collected toner from damaging the surface of the pressure roller 252 and the fixing roller 251.

In the present invention, the viscoelasticity is measured by RheoStress RS50 from HAAKE GmbH at a frequency of 1 Hz, a temperature of from 80 to 210° C., distortion of 0.1 and a temperature rising speed of 2.5° C./min, fixing 1 g of a sample on a parallel plate thereof.

The binder resin included in the toner of the present invention is preferably a polyester resin having an acid value of from 1.0 to 50.0 KOH mg/g. This is because the polyester resin having an acid value of from 1.0 to 50.0 KOH mg/g more effectively prevents the toner from adhering again to the pressure roller 252 or the fixing roller 251. When less than 1.0 KOH mg/g, such an effect is not exerted. When greater than 50.0 KOH mg/g, the low-temperature fixability of the resultant toner deteriorates.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

The charge controlling agent and release agent can be kneaded upon application of heat together with a master batch pigment and a resin. Alternatively, the charge controlling agent can be added to a toner constituent when dissolved and dispersed in an organic solvent, and is preferably fixed on a mother toner.

The toner of the present invention including a salicylic acid metal compound as a charge controlling agent in an amount of 0.5 to 6.0% by weight has less initial variation of charge quantity and easily has a required absolute charge quantity when developing. Therefore, deterioration of the resultant image quality, such as foggy images and lower image density, can be prevented. When less than 0.5% by weight, the hot offset tends to occur and charge quantity of the resultant toner tends to vary. When greater than 6.0% by weight, the low-temperature fixability of the resultant toner deteriorates.

The fixer of the present invention includes a feeder 259 feeding the reactive material to the cleaning roller 257. The feeder 259 is preferably a feed roller contacting the pressure roller 252. The feed roller 259 has a brush formed of a resin fiber, and scrapes a compact 260 of the reactive material with the brush and adhere the reactive material to the pressure roller 252. Then, the reactive material adheres to the surface of the toner transferred to the pressure roller 252 from the heat roller and is collected by the cleaning roller 257 together with the toner. The toner collected thereby reacts with the reactive material and is crosslinked to have a higher storage modulus, and firmly fixed on the cleaning roller 257. Then, the toner having a higher storage modulus does not melt and adhere to the pressure roller 252 again to contaminate the recording paper.

A toner for use in the fixer of the present invention is prepared by a pulverization method and polymerization method such as a suspension polymerization method, an emulsification dispersion polymerization method, an emulsification coagulation method and an emulsification association method, but the method is not limited thereto.

The pulverization method includes fully mixing a resin, a pigment or a dye as a colorant, a charge controlling agent and other additives with a mixer such as HENSCHEL MIXER to prepare a mixture; kneading the mixture with a heat kneader such as a batch-type two-roll mill, BUMBURY MIXER, a continuous biaxial extruder, and a continuous uniaxial kneader to prepare a kneaded mixture; extending and cooling the kneaded mixture upon application of pressure to prepare a extended and cooled mixture; shearing and crushing the extended and cooled mixture to prepare a crushed mixture; pulverizing the crushed mixture with a pulverizer such as a jet stream pulverizer and a mechanical pulverizer to prepare a pulverized mixture; classifying the pulverized mixture with a classifier using a circulating air stream or Coanda effect to prepare particles having a specified particle diameter; and externally adding an inorganic particulate material to the particles having a specified particle diameter to prepare a toner.

The polymerization method includes crosslinking and/or elongating a toner constituent comprising a polymer having an active hydrogen atom, a polyester resin, a colorant and a release agent in an aqueous medium in the presence of a particulate resin to prepare a toner.

The toner for use in the fixer of the present invention includes a wax as a release agent. The existential state of the wax in a toner largely affects releasability thereof when fixed, and when the wax is finely dispersed in a toner and present close to the surface thereof in a large amount, the toner has good releasability. Particularly, the wax is preferably dispersed with a major axis not greater than 1 μm. When the wax is present in the toner as mentioned above, the offset toner on the fixing roller and the toner collected by the cleaning roller 257 contacting the pressure roller decrease.

Specific examples of the wax include known waxes, e.g., polyolefin waxes such as polyethylene wax and polypropylene wax; long chain carbon hydrides such as paraffin wax and sasol wax; and waxes including carbonyl groups. Among these waxes, the waxes including carbonyl groups are preferably used. Specific examples thereof include polyesteralkanates such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanates such as ethylenediaminebehenylamide; polyalkylamides such as tristearylamidetrimellitate; and dialkylketones such as distearylketone. Among these waxes including a carbonyl group, the polyesteralkanate is preferably used. The wax for use in the present invention usually has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner. The content of the wax in a toner is preferably from 0 to 40% by weight, and more preferably from 3 to 30% by weight.

The toner for use in the fixer of the present invention includes a charge controlling agent. The charge controlling agent fixed on the toner surface can improve chargeability of the toner. When the charge controlling agent is fixed on the toner surface, a presence amount and status thereof can be stablilized, and therefore the chargeability of the toner can be stabilized. Particularly, the toner of the present invention has better chargeability when including the charge controlling agent.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images. The charge controlling agent and release agent can be kneaded upon application of heat together with a master batch pigment and a resin, or can be added to a toner constituent when dissolved and dispersed in an organic solvent.

The toner for use in the fixer of the present invention has an average circularity not less than 0.94. The toner having an average circularity not less than 0.94 has good dot reproducibility and transferability. When less than 0.94 and far from being spherical, the resultant toner does not face sufficient transferability and high-definition images are difficult to produce. A peripheral length of a circle having an area equivalent to that of a projected image optically detected is divided by an actual peripheral length of the toner particle to determine the circularity of the toner. Specifically, the circularity of the toner is measured by a flow-type particle image analyzer FPIA-2000 from SYSMEX CORPORATION. A specific measuring method includes adding 0.1 to 0.5 ml of a surfactant, preferably an alkylbenzene sulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

The toner has a volume-average particle diameter (Dv) of from 3.0 to 8.0 μm, and a ratio (Dv/Dn) of the volume-average particle diameter (Dv) to a number-average particle diameter thereof (Dn) of from 1.00 to 1.40. The toner having such a particle diameter and a particle diameter distribution has good thermostability, low-temperature fixability and hot offset resistance, particularly produces full-color images having good glossiness. Typically, the smaller the toner particle diameter, the more advantageous it is for producing high-resolution and high-quality images. However, it is more disadvantageous for transferability and cleanability of the toner. When a toner has a volume-average particle diameter smaller than the range of the present invention, the toner is fusion bonded with the surface of the carrier in a two-component developer when stirred for long periods in an image developer and deteriorates the chargeability of the carrier. When used in a one-component developer, a toner film tends to form over the charging roller and the toner tends to be fusion bonded with a member, such as a blade forming a thin toner layer. A toner having a volume-average particle diameter larger than the particle diameter range of the present invention causes difficulty in producing high-resolution and high-quality images, and at the same time, the variation in particle diameter thereof becomes large in many cases, when the toner is consumed and fed in a developer.

When Dv/Dn is greater than 1.40, charge quantity distribution of the resultant toner widens and images produced thereby has low resolution. The average particle diameter and particle diameter distribution of the toner can be measured by a Coulter counter TA-II and Coulter Multisizer II from Beckman Coulter, Inc. In the present invention, an Interface producing a number distribution and a volume distribution from Nikkaki Bios Co., Ltd. and a personal computer PC9801 from NEC Corp. are connected with the Coulter Multisizer II to measure the average particle diameter and particle diameter distribution. The toner of the present invention preferably has a shape factor SF-1 of from 100 to 180, and a shape factor SF-2 of from 100 to 180.

Figure 4A:
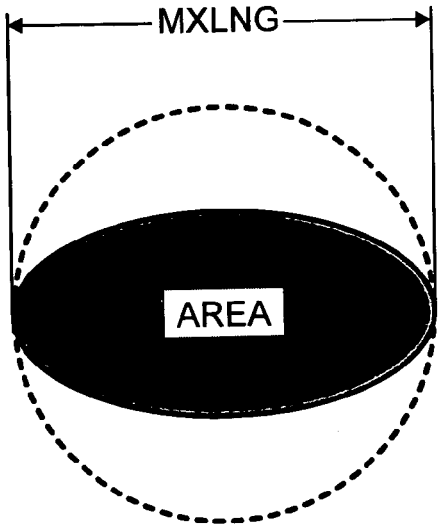
FIGS. 4A and 4B are schematic views illustrating the shape of a toner for explaining shape factors SF-1 and SF-2.
Figure 4B:
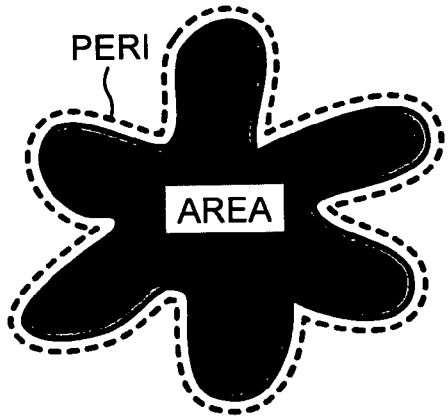

FIGS. 4A and 4B are a schematic views illustrating the shapes of a toner for explaining shape factors SF-1 and SF-2

The shape factor SF-1 represents a degree of roundness of a toner, and is determined in accordance with the following formula (1):

$$SF\text{-}1=\{(MXLNG)^2/\text{AREA}\}\times(100\pi/4) \quad (1)$$

wherein MXLNG represents an absolute maximum length of a particle and AREA represents a projected area thereof.

When the SF-1 is close to 100, the shape of the toner is close to a sphere and the toner contacts the other toner and a photoreceptor at a point. Therefore, the toners adhere less each other and have higher fluidity. When the SF-1 is greater than 180, the resultant toner has an amorphous shape, and the developability and transferability thereof deteriorate.

SF-2 represents the concavity and convexity of the shape of the toner, and specifically a square of a peripheral length of an image projected on a two-dimensional flat surface (PERI) is divided by an area of the image (AREA) and multiplied by 100π/4 to determine SF-2 as the following formula (2) shows.

$$SF\text{-}2=\{(PERI)^2/\text{AREA}\}\times(100\pi/4) \quad (2)$$

When the SF-2 is close to 100, the surface of the toner has less concavity and convexity and is smooth. The surface of the toner preferably has moderate concavities and convexities to have better cleanability. However, when the SF-2 is greater than 180, the concavity and convexity is so noticeable that the toner scatters on the resultant images.

The shape factors are measured by photographing the toner with a scanning electron microscope (S-800) from Hitachi, Ltd. and analyzing the photographed image of the toner with an image analyzer Luzex III from NIRECO Corp.

The toner for use in the fixer of the present invention has the shape of almost a spherre, which can be specified as follows.

Figure 5A:
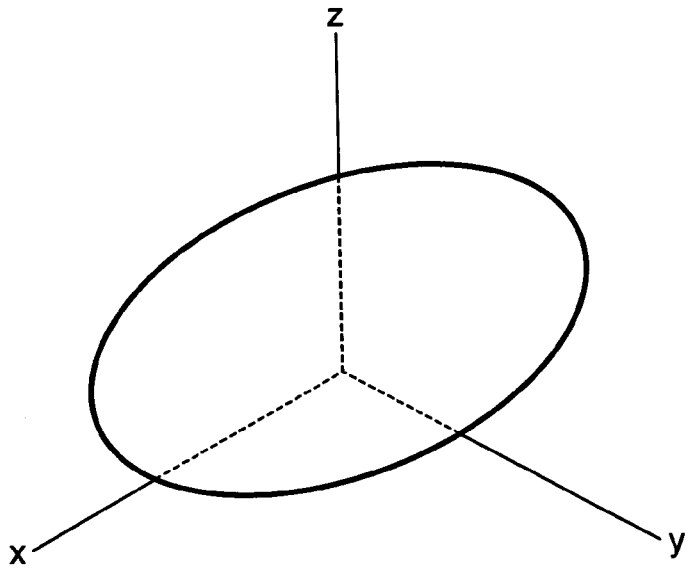
FIGS. 5A to 5C are schematic views illustrating embodiments of the shape of the toner for use in the present invention.
Figure 5B:
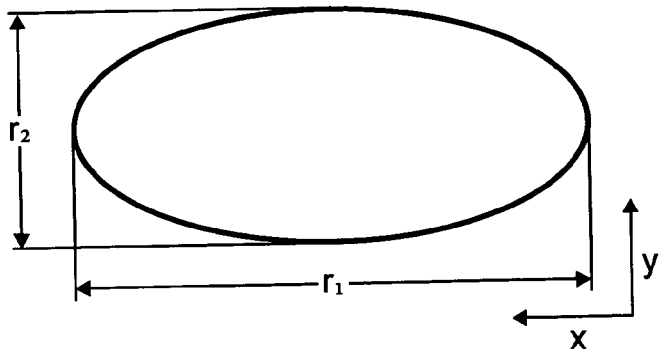
Figure 5C:
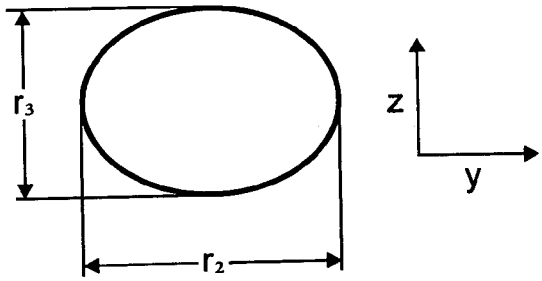

FIGS. 5A to 5C are schematic views illustrating shapes of the toner of the present invention. In FIGS. 5A to 5C, a ratio ($r_2/r_1$) of a minor axis $r_2$ to a major axis $r_1$ is preferably from 0.5 to 1.0, and a ratio ($r_3/r_2$) of a thickness $r_3$ to the minor axis ($r_2$) is preferably from 0.7 to 1.0. When the ratio ($r_2/r_1$) is less than 0.5, the resultant toner which is away from the shape of a true sphere has high cleanability, but poor dot reproducibility and transferability. When the ratio ($r_3/r_2$) is less than 0.7, the resultant toner which is close to a flat shape does not scatter so much as an amorphous toner, but does not have so high a transferability as a spherical toner does. Particularly when the ratio ($r_3/r_2$) is 1.0, the resultant toner becomes a rotating body having the major axis as a rotating axis, and fluidity thereof improves. The $r_1$, $r_2$ and $r_3$ are measured by observing the toner with a scanning electron microscope (SEM) and photographing the toner while changing a view angle.

The toner for use in the fixer of the present invention is preferably prepared by crosslinking and/or elongating a toner constituent, wherein at least a polymer capable of reacting with a compound having an active hydrogen atom, a polyester resin and a colorant are dispersed in an organic solvent, in an aqueous medium. Hereinafter, the toner constituent and a method of preparing the toner will be explained. A wet polymerization method will be explained, however, the toner may be prepared by a dry melting and kneading method.

A modified polyester resin in the present invention includes a polyester resin wherein, in addition to monomer units containing alcohol and/or acid functionality, there are monomer units present having a functional group other than acid or alcohol groups, and which can form other than an ester bond; and a polyester resin wherein plural resin components having a different structure are bonded with each other in a covalent or an electrovalent bond, etc.

For example, a polyester resin can be used having a functional group such as one or more isocyanate groups that react with an acid radical and/or a hydroxyl group at an end thereof, wherein the end is further modified or elongated with a compound including an active hydrogen atom. Further, a polyester resin having ends reacted with a compound including a plurality of hydrogen atoms can be used, such as a urea-modified polyester resin or a urethane-modified polyester resin. In addition, a polyester resin having a reactive group, such as one or more double bonds in a main chain thereof, which is radically polymerized to have a graft component, i.e., a carbon to carbon combination or in which the double bonds are crosslinked with each other can be use, such as a styrene-modified polyester resin or an acrylic-modified polyester resin.

A polyester resin copolymerized in its main chain with a resin having a different composition, or reacted with a resin having a different composition through a carboxyl group or a hydroxyl group at an end of the polyester resin can also be used, e.g., a polyester resin copolymerized with a silicone resin having an end modified by a carboxyl group, a hydroxyl group, an epoxy group or a mercapto group, such as a silicone-modified polyester resin. Hereinafter, the modified polyester resin will be more specifically explained.

724 parts of an adduct of bisphenol A with 2 moles of ethyleneoxide, 200 parts isophthalic acid, 70 parts of fumaric acid and 2 parts of dibutyltinoxide are mixed and reacted in a reactor vessel including a cooling pipe, a stirrer and a nitrogen inlet pipe for 8 hrs at a normal pressure and 230° C. Further, after the mixture is depressurized to 10 to 15 mm Hg (absolute) and reacted for 5 hrs, 32 parts of phthalic acid anhydride are added thereto and reacted for 2 hrs at 160° C. Next, 200 parts of styrene, 1 part of benzoyl peroxide, and 0.5 parts of dimethylaniline dissolved in ethyl acetate are reacted with the mixture for 2 hrs at 80° C., and the ethyl acetate is distilled and removed to prepare a polystyrene-graft-modified polyester resin (i) having a weight-average molecular weight of 92,000.

Specific examples of the urea-modified polyester resin (i) include reaction products between polyester prepolymers (A) having an isocyanate group and amines (B). The polyester prepolymer (A) is formed from a reaction between polyester having an active hydrogen atom formed by polycondensation between a polyol (1) and a polycarboxylic acid (2), and polyisocyanate (3). Specific examples of the groups including the active hydrogen include a hydroxyl group (such as an alcoholic hydroxyl group and a phenolic hydroxyl group) , an amino group, a carboxyl group, a mercapto group, etc. In particular, the alcoholic hydroxyl group is preferably used.

As the polyol (1), diol (1-1) and polyols having 3 valences or more (1-2) can be used, and (1-1) alone or a mixture of (1-1) and a small amount of (1-2) are preferably used. Specific examples of diol (1-1) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, an alkylene glycol having 2 to 12 carbon atoms and adducts of bisphenol with an alkylene oxide are preferably used, and a mixture thereof is more preferably used. Specific examples of the polyol having 3 valences or more (1-2) include multivalent aliphatic alcohols having 3 to 8 or more valences such as glycerin, trimethylolethane, trimethylolpropane, pentaerythritol and sorbitol; phenols having 3 or more valences such as trisphenol PA, phenolnovolak, cresolnovolak; and adducts of the above-mentioned polyphenol having 3 or more valences with an alkylene oxide.

As the polycarboxylic acid (2), dicarboxylic acids (2-1) and polycarboxylic acids having 3 or more valences (2-2) can be used. (2-1) alone, or a mixture of (2-1) and a small amount of (2-2) are preferably used. Specific examples of the dicarboxylicacid (2-1) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalene dicarboxylic acid. In particular, analkenylene dicarboxylic acid having 4 to 20 carbon atoms and an aromatic dicarboxylic acid having 8 to 20 carbon atoms are preferably used. Specific examples of the polycarboxylic acid having 3 or more valences (2-2) include aromatic polycarboxylic acids having 9 to 20 carbon atoms such as trimellitic acid and pyromellitic acid. The polycarboxylic acid (2) can be formed from a reaction between one or more of the polyols (1) and an anhydride or lower alkyl ester of one or more of the above-mentioned acids. Suitable preferred lower alkyl esters include, but are not limited to, methyl esters, ethyl esters and isopropyl esters.

The polyol (1) and polycarboxylic acid (2) are mixed such that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the polyisocyanate (3) include aliphatic polyisocyanates such as tetramethylenediisocyanate, hexamethylenediisocyanate and 2,6-diisocyanatemethylcaproate; alicyclic polyisocyanates such as isophoronediisocyanate and cyclohexylmethanediisocyanate; aromatic diisocyanates such as tolylenedisocyanate and diphenylmethanediisocyanate; aromatic aliphatic diisocyanates such as $\alpha,\alpha,\alpha',\alpha'$-tetramethylxylylenediisocyanate; isocyanurates; the above-mentioned polyisocyanates blocked with phenol derivatives, oxime and caprolactam; and their combinations.

The polyisocyanate (3) is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates When [NCO] has a molar ratio less than 1, a urea content in ester of the modified polyester decreases and hot offset resistance of the resultant toner deteriorates. A content of the constitutional component of a polyisocyanate in the polyester prepolymer (A) having a polyisocyanate group at its end is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low-temperature fixability of the toner also deteriorate. In contrast, when the content is greater than 40% by weight, low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of isocyanate groups is less than 1 per molecule, the molecular weight of the modified polyester (i) decreases and hot offset resistance of the resultant toner deteriorates.

Specific examples of the amines (B) include diamines (B1), polyamines (B2) having three or more amino groups, amino alcohols (B3), aminomercaptans (B4), aminoacids (B5) and blocked amines (B6) in which the amino groups in the amines (B1) to (B5) are blocked. Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophorondiamine; aliphatic diamines such as ethylene diamine, tetramethylene diamine and hexamethylene diamine, etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc. Among these amines (B), diamines (B1) and mixtures in which a diamine (B1) is mixed with a small amount of a polyamine (B2) are preferably used.

The molecular weight of the modified polyesters (i) can optionally be controlled using an elongation anticatalyst, if desired. Specific examples of the elongation anticatalyst include monoamines such as diethyl amine, dibutyl amine, butyl amine and lauryl amine, and blocked amines, i.e., ketimine compounds prepared by blocking the monoamines mentioned above.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, the molecular weight of the urea-modified polyester (i) decreases, resulting in deterioration of hot offset resistance of the resultant toner. The modified polyester (i) may include a urethane bonding as well as a urea bonding. A molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The modified polyester of the present invention has a main peak molecular weight of from 1,000 to 10,000, and preferably from 2,000 to 8,000. When constituents having a molecular weight less than 1,000 increases, the thermostable preservability of the resultant toner deteriorates. When constituents having a molecular weight greater than 10,000 increases, the low-temperature fixability of the resultant toner deteriorates. The modified polyester includes polymers having a molecular weight not less than 30,000 in an amount of from 1 to 10% by weight, and more preferably from 3 to 6% by weight although depending on the toner constituent. When less than 1% by weight, the resultant toner does not have sufficient hot offset resistance. When greater than 105 by weight, the glossiness and transparency of the resultant toner occasionally deteriorate.

The hot offset resistance of the toner including a polyester resin including a tetrahydrofuran (THF) -insoluble constituent in an amount of 1 to 25% by weight is further improved. In addition, such a toner improves deterioration of image quality caused by generation of ultrafine particles of the toner due to stress with a developing roller, a toner feed-roller, a layer-thickness regulation blade and a friction-charged blade; and burial of a fluidizer on the surface of the toner while stirred in an image developer. However, the THF-insoluble constituent adversely affects the glossiness and transparency of a color toner although improving the hot offset resistance thereof, but an amount of 1 to 10% by weight thereof occasionally exerts an effect.

In the present invention, an unmodified polyester resin (ii) can be used in combination with the modified polyester resin (i) as a toner binder resin. It is more preferable to use the unmodified polyester resin (ii) in combination with the modified polyester resin than to use the modified polyester resin alone because low-temperature fixability and glossiness of full color images of the resultant toner improve. Specific examples of the unmodified polyester resin (ii) include polycondensed products between the polyol (1) and polycarboxylic acid (2) similarly to the modified polyester resin (i), and the components preferably used are the same as those thereof. It is preferable that the modified polyester resin (i) and unmodified polyester resin (LL) are partially soluble with each other in terms of the low-temperature fixability and hot offset resistance of the resultant toner. Therefore, the modified polyester resin (i) and unmodified polyester resin (ii) preferably have similar compositions. When the unmodified polyester resin (ii) is used in combination, a weight ratio ((i)/(ii)) between the modified polyester resin (i) and unmodified polyester resin (ii) is from 5/95 to 80/20, preferably from 5/95 to 30/70, more preferably from 5/95 to 25/75, and most preferably from 7/93 to 20/80. When the modified polyester resin (i) has a weight ratio less than 5%, the resultant toner has poor hot offset resistance, and has difficulty in having a thermostable preservability and low-temperature fixability.

The unmodified polyester resin (ii) preferably has a peak molecular weight of from 1,000 to 20,000, preferably from 1,500 to 10,000, and more preferably from 2,000 to 8,000. When less than 1,000, the thermostable preservability of the resultant toner deteriorates. When greater than 10,000, the low-temperature fixability thereof deteriorates. The unmodified polyester resin (ii) preferably has a hydroxyl value not less than 5 mg KOH/g, more preferably of from 10 to 120 mg KOH/g, and most preferably from 20 to 80 mg KOH/g. When less than 5 the resultant toner has difficulty in having thermostable preservability and low-temperature fixability. The unmodified polyester resin (ii) preferably has an acid value of from 10 to 30 mg KOH/g such that the resultant toner tends to be negatively charged and to have better fixability. When greater than 30 mg KOH/g, chargeability of the resultant toner occasionally deteriorates and produces images having background fouling particularly when used in an environment of high humidity and high temperature.

In the present invention, the unmodified polyester resin (ii) preferably has a glass transition temperature (Tg) of from 35 to 55° C., and more preferably from 40 to 55° C. The resultant toner can have thermostable preservability and low-temperature fixability. A dry toner of the present invention including the unmodified polyester resin (ii) and the modified polyester resin (i) has a better thermostable preservability than known polyester toners even though the glass transition temperature is low.

In the present invention, the toner binder resin preferably has a temperature at which a storage modulus of the toner binder resin is 10,000 dyne/cm$^2$ at a measuring frequency of 20 Hz (TG'), of not less than 100° C., and more preferably of from 110 to 200° C. When less than 100° C., the hot offset resistance of the resultant toner deteriorates. The toner binder resin preferably has a temperature at which the viscosity is 1,000 poise (Tη), of not greater than 180° C., and more preferably of from 90 to 160° C. When greater than 180° C., the low-temperature fixability of the resultant toner deteriorates. Namely, TG' is preferably higher than Tη in terms of the low-temperature fixability and hot offset resistance of the resultant toner. In other words, the difference between TG' and Tη (TG'−Tη) is preferably not less than 0° C., more preferably not less than 10° C., and furthermore preferably not less than 20° C. The maximum of the difference is not particularly limited. In terms of the thermostable preservability and low-temperature fixability of the resultant toner, the difference between TG' and Tη (TG'−Tη) is preferably from 0 to 100° C., more preferably from 10 to 90° C., and most preferably from 20 to 80° C.

As for a release agent and a charge controlling agent, known release agents and charge controlling agents can be used as desired.

An inorganic particulate material is preferably used as an external additive. The inorganic particulate material preferably has a primary particle diameter of from 5 mμ to 2 μm, and more preferably from 5 mμ. to 500 mμ. In addition, the inorganic particulate material preferably has a specific surface area of from 20 to 500 $m^2/g$ when measured by the BET method. The toner of the present invention preferably includes the inorganic particulate material in an amount of from 0.01 to 5.0% by weight, and more preferably from 0.01 to 2.0% by weight. Specific preferred examples of the suitable inorganic particulate materials include silica, titanium oxide, alumina, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. Besides, polymer particulate materials such as polystyrene formed by a soap-free emulsifying polymerization, a suspension polymerization or a dispersing polymerization, methacrylate ester or acrylate ester copolymers, silicone resins, benzoguanamine resins, polycondensation particles such as nylon and polymer particles of thermosetting resins can also be used.

A surface treatment agent can increase the hydrophobicity of these external additives and prevent deterioration of fluidity and chargeability of the resultant toner even in high humidity. Any desired surface treatment agent may be used, depending on the properties of the treated particle of interest. Specific preferred examples of the surface treatment agent include silane coupling agents, silylating agents, silane coupling agents having an alkyl fluoride group, organic titanate coupling agents, aluminum coupling agents silicone oils and modified silicone oils.

The toner of the present invention may also include a cleanability improver for removing a developer remaining on a photoreceptor and a first transfer medium after transfer. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. The polymer particles have a comparatively narrow particle diameter distribution and preferably have a volume-average particle diameter of from 0.01 to 1 μm.

Specific examples of the colorants for use in the present invention include any known dyes and pigments such as carbon black, Nigrosine dyes, black ironoxide, Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet, Vulcan Fast Rubine B, Brilliant Scarlet G, LITHOL RUBINE GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light,. BON Maroon Medium, Eosin Lake, Rhodamine Lake B, Rhodamine Lake Y, Alizarine Lake, Thioindigo Red B, Thioindigo Maroon, Oil Red, Quinacridone Red, PYRAZOLONE Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussianblue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Napthol Green B, Green Gold, Acid Green Lake, Malachite Green Lake, Phthalocyanine Green, Anthraquinone Green, titanium oxide, zinc oxide, lithopone and the like. These materials are used alone or in combination. The content of the colorant in the toner is preferably from 1 to 15% by weight, and more preferably from 3 to 10% by weight, based on total weight of the toner.

The colorant for use in the present invention can be used as a master batch pigment, if desired, when combined with a resin. Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination. The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed, can be preferably used because the resultant wet cake of the colorant can be used as it is. Of course, a dry powder which is prepared by drying the wet cake can also be used as a colorant. In this case, a three roll mill is preferably used for kneading the mixture upon application of high shearing stress.

The dry toner of the present invention can be prepared by, but is not limited to, the following method.

The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

As a method of stably preparing a dispersion formed of the prepolymer (A) and the unmodified polyester resin (ii) in an aqueous medium, a method of including a toner constituent formed of the prepolymer (A) and the unmodified polyester resin (ii) into an aqueous medium and dispersing them upon application of shear stress is preferably used. The prepolymer (A), the unmodified polyester resin (ii) and other toner constituents (hereinafter referred to as toner materials) such as colorants, master batch pigments, release agents and charge controlling agents, etc. may be added into an aqueous medium at the same time when the dispersion is prepared. However, it is preferable that the toner materials are previously mixed, and then are added to the aqueous medium. In addition, other toner materials such as colorants, release agents, charge controlling agents, etc., are not necessarily added to the aqueous dispersion before particles are formed, and may be added thereto after particles are prepared in the aqueous medium. For example, after forming particles without a colorant, a colorant can also be added thereto by known dying methods.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, the modified polyester (i) or prepolymer (A) can easily be dispersed because the dispersion formed thereof has a low viscosity.

A content of the aqueous medium to 100 parts by weight of the toner constituent including the prepolymer (A) and the unmodified polyester resin (ii) or is typically from 50 to 2,000 parts by weight, and preferably from 100 to 1,000 parts by weight. When the content is less than 50 parts by weight, the dispersion of the toner constituent in the aqueous medium is not satisfactory, and thereby the resultant mother toner particles do not have a desired particle diameter. In contrast, when the content is greater than 2,000, the production cost increases. A dispersant can preferably be used to prepare a stably dispersed dispersion including particles having a sharp particle diameter distribution.

The urea-modified polyester may be prepared from the prepolymer (A) by adding amines (B) in the aqueous medium before or after the toner constituent is dispersed therein. The urea-modified polyester is preferentially formed on the surface of the resultant toner, and which can have a gradient of concentration thereof inside.

Specific preferred examples of the dispersants used to emulsify and disperse an oil phase in an aqueous liquid in which the toner constituent is dispersed, include anionic surfactants such as alkylbenzene sulfonic acid salts, α-olefin sulfonic acid salts, and phosphoric acid salts; cationic surfactants such as amine salts (e.g., alkyl amine salts, amino alcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride) ; nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine. A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium-{omega-fluoroalkanoyl(C6-C8)-N-ethylamino}-1-propane sulfonate, fluoroalkyl(C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; METGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including a toner constituent in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite, which are hardly soluble in water, can also be used.

Further, it is possible to stably disperse a toner constituent in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyalkylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calcium phosphate or a material soluble in alkaline is used as a dispersant, the calcium phosphate is dissolved with an acid such as a hydrochloric acid and washed with water remove the calcium phosphate from the toner particle Besides this method, it can also be removed by an enzymatic hydrolysis.

When a dispersant is used, the dispersant may remain on a surface of the toner particle. However, the dispersant is preferably washed and removed after the elongation and/or crosslinking reaction of the prepolymer with amine in terms of chargeability of the resultant toner.

Further, to decrease viscosity of a dispersion medium including the toner constituent, a solvent which can dissolve the prepolymer (A) or the unmodified polyester resin (ii) can be used because the resultant particles have a sharp particle diameter distribution. The solvent is preferably volatile and has a boiling point lower than 100° C., from the viewpoint of being easily removed from the dispersion after the particles are formed. Specific examples of such a solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom under a normal or reduced pressure after the particles are subjected to an elongation reaction and/or a crosslinking reaction of the prepolymer with amine.

The elongation and/or crosslinking reaction time depend on reactivity of the isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To remove an organic solvent from the emulsified dispersion, a method of gradually raising the temperature of the whole dispersion to completely remove the organic solvent in the droplet by vaporizing can be used. Otherwise, a method of spraying the emulsified dispersion in dry air, completely removing a water-insoluble organic solvent from the droplet to form toner particles and removing the water dispersant by vaporizing can also be used. As the dry air, atmospheric air, nitrogen gas, carbon dioxide gas, a gaseous body in which a combustion gas is heated, and particularly various aerial currents heated to have a temperature not less than a boiling point of the solvent used are typically used. A spray dryer, a belt dryer and a rotary kiln can sufficiently remove the organic solvent in a short time.

When the emulsified dispersion is washed and dried while maintaining a wide particle diameter distribution thereof, the dispersion can be classified to have a desired particle diameter distribution.

A cyclone, a decanter, a centrifugal separation, etc. can remove particles in a dispersion liquid. The powder remaining after the dispersion liquid is dried can be classified, but the liquid is preferably classified in terms of efficiency. Unnecessary fine and coarse particles can be recycled to a kneading process to form particles. The fine and coarse particles may be wet when recycled.

The dispersant is preferably removed from the dispersion liquid, and more preferably removed at the same time when the above-mentioned classification is performed.

Heterogeneous particles such as release agent particles, charge controlling particles, fluidizing particles and colorant particles can be mixed with the toner powder after drying. Release of the heterogeneous particles from composite particles can be prevented by giving a mechanical stress to a mixed powder to fix and fuse them on a surface of the composite particles.

Specific methods include a method of applying an impact force on the mixture with a blade rotating at high-speed, a method of putting a mixture in a high-speed stream and accelerating the mixture such that particles thereof collide with each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries Ltd., an automatic mortar, etc.

The toner of the present invention can be used for a two-component developer in which the toner is mixed with a magnetic carrier. A content of the toner is preferably from 1 to 10 parts by weight per 100 parts by weight of the carrier. Suitable carriers for use in the two component developer include, but are not limited to, known carrier materials such as iron powders, ferrite powders, magnetite powders, and magnetic resin carriers, which have a particle diameter of from about 20 to about 200 μm. The carrier may be coated by a resin. Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins. An electroconductive powder may optionally be included in the toner. Specific examples of such electroconductive powders include, but are not limited to, metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic or non-magnetic developer without a carrier.

In order to increase the fluidity, preservability, developability and transferability of the developer, an inorganic particulate material such as a fine powder of a hydrophobic silica may be added thereto. Known powder mixers, preferably capable of controlling the inner temperature including a jacket, can be used to mix an external additive with the developer. The external additive may gradually be added in the mixer or on the way of mixing to change the history of stressing the external additive. As a matter of course, the number of rotations, rotation speed, mixing time and mixing temperature of the mixer may be changed. A large stress may be applied to the external additive at the beginning, and comparatively a small stress is applied thereto then, or vice versa. Specific examples of the mixers include V-type Mixer, Rocking Mixer, Loedge Mixer, NAUTA Mixer and HENSCHEL MIXER.

Figure 6:
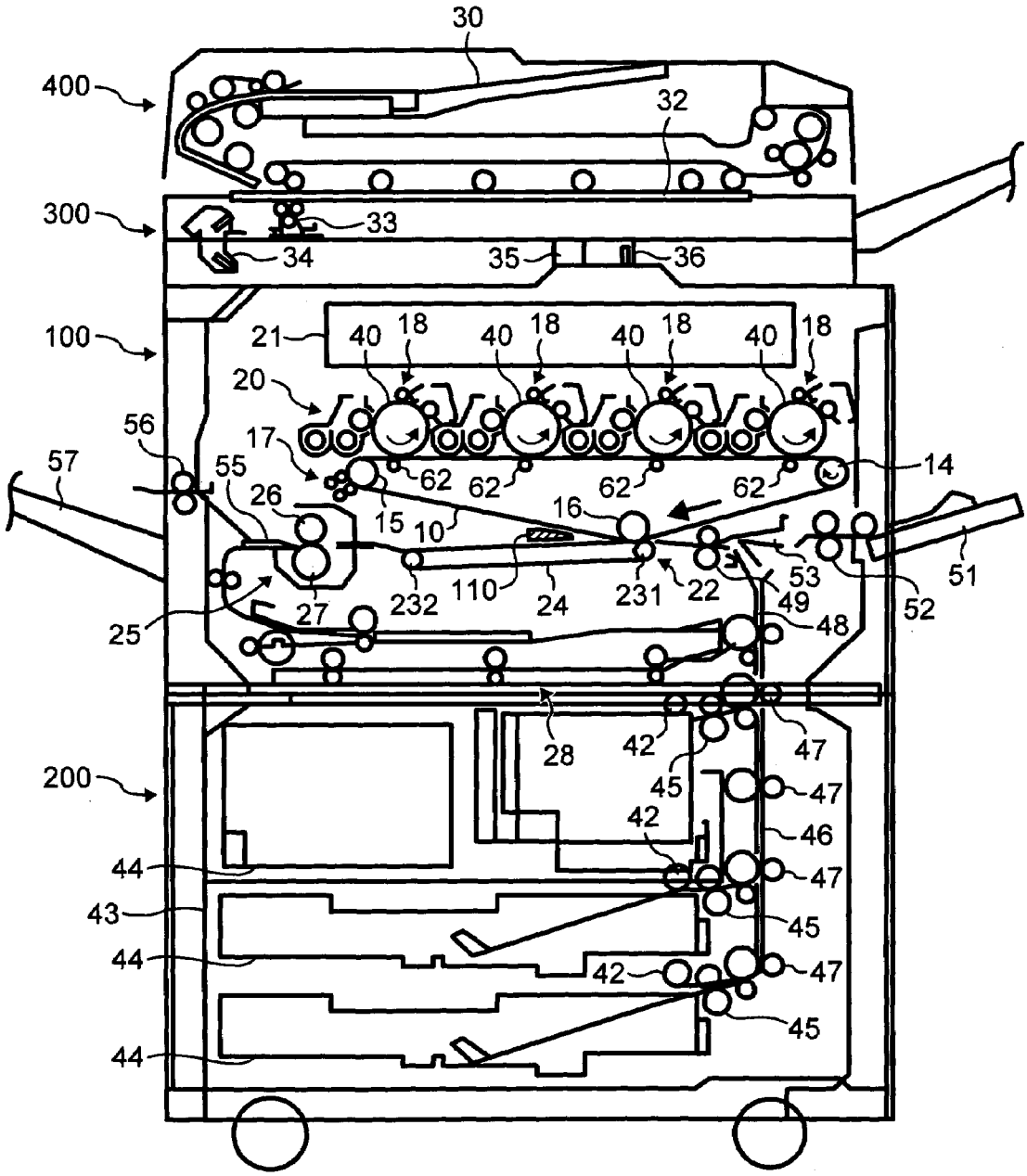
FIG. 6 is a schematic view illustrating an embodiment of the image forming apparatus of the present invention.

FIG. 6 is a schematic view illustrating an embodiment of the image forming apparatus of the present invention, wherein a copier 100 includes a paper feeding table 200, a scanner 300 thereon and a document feeder (ADF) 400 on the scanner.

The copier 100 includes a tandem-type image forming apparatus 20 including four image forming devices 18 in parallel, including means for performing electrophotographic processes such as charging, developing and cleaning around a photoreceptor 40 as a latent image bearer. Above the tandem-type image forming apparatus 20, an irradiator 21 is located irradiating the photoreceptor 40 with a laser beam based on image information to form a latent image thereon. An intermediate transfer belt 10, formed of an endless belt, is located facing each photoreceptor 40 in the tandem-type image forming apparatus 20. A transferer 62, transferring a toner image of each color formed on the photoreceptors 40 onto the intermediate transfer belt 10, is located facing the photoreceptor 40 through the intermediate transfer belt 10.

A second transferer 22, transferring the toner images overlapped on the intermediate transfer belt 10 at a time onto a transfer paper fed from the paper feeding table 200, is located below the intermediate transfer belt 10. The second transferer 22 includes an endless second transfer belt 24 running between two roller 23 with tension, and is pressed against a support roller 16 through the intermediate transfer belt 10 to transfer the toner images thereon onto the transfer paper. A fixer 25 fixing the toner image on the transfer paper is located beside the second transferer 22. The fixer 25 includes an endless fixing belt 26 and a pressure roller 27 pressed against the fixing belt 26.

The second transferer 22 also transports the transfer paper having the transferred image on to the fixer 25. The second transferer 22 may include a transfer roller and a non-contact charger, and in that case, the second transferer 22 is difficult to transport the transfer paper.

In this embodiment, a reverser 28 reversing the transfer paper to record images on both sides thereof is located below the second transferer 22 and the fixer 25 in parallel with the tandem-type image forming apparatus 20.

A developer including the toner of the present invention is used in an image developer 4 in the image forming device 18. The image developer 4 bears and transports the developer with a developer bearer to a position facing the photoreceptor 40 to develop the latent image thereon upon application of an alternative electric field. The alternative electric field activates the developer, limits a charge quantity distribution of the toner and improves developability thereof.

The image developer 4 together with the photoreceptor 40 can be a process cartridge detachable with an image forming apparatus. The process cartridge may include a charger and a cleaner besides the image developer and the photoreceptor.

The image forming apparatus works as follows.

First, an original is set on an original table 30 of the ADF 400, or on a contact glass 32 of the scanner 300 after opening the ADF 400, and the ADF 400 is closed to press the original.

When a start switch (not shown) is pushed, after the original on the original table 30 is transported onto the contact glass 32, and immediately when the original is set thereon, the scanner 300 works to run a first runner 33 and a second runner 34. The first runner 33 emits light from its light source and reflects reflected light from the original toward the second runner 34. The second runner 34 reflects the light with a mirror to a reading sensor 36 through an image forming lens 35 to read the image information.

When a start switch (not shown) is pushed, a drive motor (not shown) rotates one of support rollers 14, 15 and 16, and the other two rollers are rotated in accordance with the roller driven by the motor to drive the intermediate transfer belt 10. At the same time, each image forming device 18 rotates the photoreceptor 40 and forms a single color image of black, yellow, magenta and cyan thereon, and each single color image is transferred in order on the intermediate transfer belt 10 to form a composite color image thereon.

When a start switch (not shown) is pushed, one of paper feed rollers 42 of the paper feeding table 200 is selectively rotated to pick up the transfer paper from one of multiple-stage paper feeding cassettes 44, and a separation roller 45 separates the transfer papers one by one and transfers the transfer paper to a paper feeding route 46. A transfer roller 47 leads the transfer paper to a paper feeding route 48 in the copier 100 and the transfer paper is stopped against a resist roller 49.

Alternatively, a paper feed roller 50 is rotated to pick up the transfer paper on a manual feeding tray 51. A separation roller 52 separates the transfer papers one by one and transfers the transfer paper to a paper feeding route 53, and the transfer paper is stopped against the same resist roller 49.

Then, the resist roller 49 is timely rotated when the composite color image is formed on the intermediate transfer belt 10 to transfer the transfer paper to a gap between the intermediate transfer belt 10 and the second transferer 22, and the second transferer transfers the composite color image onto the transfer paper.

The transfer paper having the transferred image is transferred to the fixer 25 by the second transferer 22. After the toner image is fixed on the transfer paper upon application of pressure and heat, a switch-over pick 55 switches over the transfer paper and a delivery roller 56 delivers the transfer paper onto a delivery tray 57. Alternatively, the switch-over pick 55 switches over the transfer paper to the reverser 28 revering the transfer paper and leading the transfer paper again to the transfer position to transfer an image on a backside thereof, and the delivery roller 56 delivers the transfer paper onto the delivery tray 57.

The intermediate transfer belt 10 removes a residual toner remaining thereon after transferred with an intermediate transfer belt cleaner 17, and is prepared for another image formation by the tandem-type image forming apparatus 20.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation Example 1

[Synthesis of Modified Polyester Resin (A-1)]

358 parts of an adduct of bisphenol A with 2 moles of ethyleneoxide, 381 parts of an adduct of bisphenol A with 2 moles of propyleneoxide, 200 parts isophthalic acid, 127 parts of terephthalic acid and 2 parts of dibutyltinoxide are mixed and reacted in a reactor vessel including a cooling pipe, a stirrer and a nitrogen inlet pipe for 8 hrs at normal pressure and 230° C. After the mixture is depressurized to 10 to 15 mm Hg (absolute) and reacted for 5 hrs to prepare a polyester prepolymer having a hydroxyl value of 25 and an acid value of 0.9. The polyester prepolymer was cooled to have a temperature of 80° C. 364 parts of ethyl acetate and 98 parts of isophoronediisocyanate were added thereto and the mixture was reacted at 110° C. for 2 hrs to prepare an ethylacetate solution having a solid content concentration of 75% of a modified polyester resin (A-1) having a weight-average molecular weight (Mw) of 12,000 and 1.29% by weight of NCO.

Preparation Example 2

[Synthesis of Blocked Amine (B)]

30 parts of isophoronediamine and 70 parts of methyl ethyl ketone were mixed in a reactor vessel having a thermometer with a stirrer at 50° C. for 5 hrs to prepare a blocked amine (B)

Preparation Example 3

[Synthesis of Low-Molecular-Weight Polyester]

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs, 44 parts of trimellitic acid anhydride were added thereto and the mixture was reacted for 1.8 hrs at a normal pressure and 180° C. to prepare a [low-molecular-weight polyester 1]. The [low-molecular-weight polyester 1] had a number-average molecular weight of 2,500, a weight-average molecular weight of 6,700, a peak molecular weight of 5,000, a Tg of 43° C. and an acid value of 25.

Preparation Example 4

[Synthesis of Carbon Black Masterbatch Resin]

1,200 parts of water, 540 parts of carbon black PRINTEX 35 from Degussa A. G. having a DBP oil absorption of 42 ml/100 mg and a pH of 9.5, 1,200 parts of the [low-molecular-weight polyester 1] were mixed by a kneader upon application of pressure. After the mixture was kneaded by a two-roll mill having a surface temperature of 150° C. for 30 min, the mixture was rolled, cooled and pulverized by a pulverizer to prepare a carbon black masterbatch resin.

[Synthesis of Parent Toner Particles (1)]

100 parts of the carbon black masterbatch resin, 50 parts of an ethylacetate solution having a concentration of 10% of a carnauba wax dispersed by a wet process to have an average particle diameter of 0.5 μm with a beads mill and 70 parts of ethylacetate were stirred in a beaker until uniformly dispersed to prepare a mixture. Further, 20 parts of the ethylacetate solution of a modified polyester resin (A-1) and 1.2 parts of the blocked amine (B) were mixed with the mixture to prepare a liquid including a resin and a colorant (1), having a solid content concentration of 50%. Then, 560 parts of water, 3.6 parts (only solid contents) of an aqueous dispersion of particulate methyl polymethacrylate (PB-200H from Kao Corporation and 3 parts of sodium dodecyl naphthalenesulfonate salt were added to the liquid including a resin and a colorant (1), and which were mixed by TK HOMOMIXER from TOKUSHU KIKA KOGYO CO., LTD. at 12,000 rpm and 25° C. for 1 min to prepare an emulsified dispersion (X).

100 parts of the emulsified dispersion (X) were put in a stainless flask having a helical ribbon type 3-stage stirring blade, and the ethylacetate was removed therefrom under reduced pressure (10 kPa) at 25° C. for 6 hrs to have a concentration of 8% while stirring the emulsified dispersion (X) at 60 rpm to prepare an emulsified dispersion (Y-1).

10 hrs after the emulsified dispersion (Y-1) was prepared, 1.9 parts of carboxymethylcellulose (CELLOGEN HH from DAI-ICHI KOGYO SEIYAKU CO., LTD.) were added thereto to be thickened. Then, the emulsified dispersion had a viscosity of 6,000 mPa·s. Then, the ethylacetate was removed therefrom under reduced pressure (10 kPa) to have a concentration of 3% while stirring the emulsified dispersion at 300 rpm. The ethylacetate was further removed therefrom to have a concentration of 1% at 60 rpm.

100 parts of this emulsified dispersion were subjected to a centrifugal separation to prepare a cake, and 60 parts of water were added thereto to be subjected to a centrifugal separation again, which was repeated 5 times. Then, the final cake was dried at 35° C. for48 hrs to prepare parent toner particles (1).

Next, 100 parts of the parent toner particles (1) and 0.4 parts of charge controlling agent BONTRON X-11 from Orient Chemical Industries, Ltd. were mixed by a Q-type mixer from Mitsui Mining Co., Ltd., wherein a peripheral speed of a turbine blade thereof was 50 m/sec. This mixing operation included 5 cycles of 2 min mixing (total 10 min) and 1 min pausing.

Further, 0.5 parts of hydrophobic silica H2000 from Clariant (Japan) K.K. were mixed therein at a peripheral speed of 15 m/sec, which included 5 cycles of 30 sec mixing and 1 min pausing, to prepare a black toner.

Preparation Example of Carrier

The following materials were mixed and dispersed by a homomixer for 20 min to prepare a coating liquid. The coating liquid was coated by a fluidized-bed coater on 1,000 parts of spherical magnetite having a particle diameter of 50 μm to prepare a magnetic carrier A.

| | |
|---|---|
| Silicone resin (organo straight silicone) | 100 |
| Toluene | 100 |
| γ-(2-aminoethyl)aminopropyltrimethoxysilane | 5 |
| Carbon black | 10 |

4 parts of the black toner and 96 parts of the magnetic carrier A were mixed by a ball mill to prepare a two-component developer 1.

Example 1

As a fixer, the fixer in imagio NEO451 from Ricoh Company, Ltd. was used, and MY RECYCLE 100W was set therein to perform a copying test. The cleaning roller is formed of aluminum having a diameter of 10 mm and a surface smoothness Rz of 10 μm. A coating liquid, wherein a reactive material BONTRON X-11 from Orient Chemical Industries, Ltd. enlarging the storage modulus (viscoelasticity) of the toner was dissolved in toluene, was coated and dried on the surface of the cleaning roller having a length of 300 mm in the longitudinal direction with a brush to have a dry weight of 0.07 g per one cleaning roller.

Example 2

The procedure for performing a copying test in Example 1 was repeated except for coating and drying the coating liquid on the cleaning roller to have a dry weight of 0.15 g per one cleaning roller.

Comparative Example 1

The procedure for performing a copying test in Example 1 was repeated except for not coating and drying the coating liquid on the cleaning roller.

Hot Offset Evaluation

Whether the toner was melted out from the cleaning roller to a fixed image was visually observed. A4 charts having an image area of 6% were continuously printed on both sides of transfer papers.

○: No hot offset

Δ: Hot offset was observed

X: Transfer papers twined and jammed around the cleaning roller

TABLE 1

| | Storage at 120° C. modulus (Pa) | | | Storage at 180° C. modulus (Pa) | |
|---|---|---|---|---|---|
| | Toner impurity collected by the cleaning roller (TI) | Toner (T) | TI/T | Toner impurity collected by the cleaning roller | Toner |
| Com. Ex. 1 | 5,129 | 9,064 | 0.57 | 412 | 1,883 |
| Ex. 1 | 11,150 | 9,064 | 1.23 | 814 | 1,883 |
| Ex. 2 | 41,160 | 9,064 | 4.54 | 5,915 | 1,883 |

In Example 1, ○ until 50,000 images (25,000 sheets) were produced, and Δ when 150,000 images were produced. In Example 2, ○ until 150,000 images were produced. In Comparative Example 1, Δ when 50,000 images were produced and X when 65,000 images were produced, and the evaluation was stopped then.

In Comparative Example 1, the storage modulus of the toner impurity collected by the cleaning roller when 65,000 images were produced was measured, and in Examples 1 and 2, the storage modulus of the toner impurity collected by the cleaning roller when 150,000 images were produced was measured.

Example 3

The procedure for performing a copying test in Example 1 was repeated except for adding the [low-molecular-weight polyester 1] in the coating liquid as a binder resin, and coating and drying the coating liquid on the cleaning roller such that the reactive material had a dry weight of 0.07 g and the binder resin had a dry weight of 0.02 g per one cleaning roller.

Example 4

The procedure for performing a copying test in Example 1 was repeated except for adding the [low-molecular-weight polyester 1] in the coating liquid as a binder resin, and coating and drying the coating liquid on the cleaning roller such that the reactive material had a dry weight of 0.07 g and the binder resin had a dry weight of 0.07 g per one cleaning roller.

Peeling Evaluation

Whether the reactive material was peeled off from the cleaning roller was visually observed. Even when the reactive material was peeled off therefrom, the production of images was continued until the fixed image was contaminated.

The evaluation results of Examples 1, 3 and 4 and Comparative Example 1 are shown in Table 2.

TABLE 2

| | Reactive Material | Resin | Hot offset | | |
|---|---|---|---|---|---|
| | (g) | (g) | 40,000 | 140,000 | Peeling |
| Example 1 | 0.07 | 0 | ○ | ○ | Peeled when 2,000 images were produced |
| Example 3 | 0.07 | 0.02 | ○ | ○ | Peeled when 4,000 images were produced |
| Example 4 | 0.07 | 0.07 | ○ | ○ | No peeling |

TABLE 2-continued

| | Reactive Material | Resin | Hot offset | | |
|---|---|---|---|---|---|
| | (g) | (g) | 40,000 | 140,000 | Peeling |
| Comparative Example 1 | 0 | 0 | Δ | X jammed when 65,000 images were produced | |

Example 5

[Synthesis of an Organic Particulate Resin Emulsion]

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare a [particulate resin dispersion liquid 1] of a vinyl resin (a copolymer of a sodium salt of an adduct of styrene-methacrylate-butylacrylate-sulfuric ester with ethyleneoxide methacrylate) . The [particulate resin dispersion liquid 1] was measured by LA-920 to find a volume-average particle diameter thereof was 0.10 μm. A part of the [particulate resin dispersion liquid 1] was dried to isolate a resin component therefrom. The resin component had a Tg of 57° C.

[Preparation of Aqueous Phase]

990 parts of water, 80 parts of the [particulate resin dispersion liquid 1], 40 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid, i.e., an [aqueous phase 1]

[Synthesis of Low-Molecular-Weight Polyester]

220 parts of an adduct of bisphenol A with 2 moles of ethyleneoxide and 561 parts of an adduct of bisphenol A with 3 moles of propyleneoxide, 218 parts terephthalic acid, 48 parts of an adipic acid and 2 parts of dibutyltinoxide were reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs, 45 parts of a trimellitic acid anhydride were added therein and the mixture was reacted for 2 hrs at normal pressure and 180° C. to prepare [low-molecular-weight polyester 1]. The [low-molecular-weight polyester 1] had a number-average molecular weight of 2,500, a weight-average molecular weight of 6,700, a Tg of 43° C. and an acid value of 25 mg KOH/g.

[Synthesis of Prepolymer]

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 7 hrs at a normal pressure and 230° C. Further, after the mixture was depressurized to 10 to 15 mm Hg and reacted for 5 hrs to prepare an [intermediate polyester 1]. The intermediate polyester 1 had a number-average molecular weight of 2,100, a weight-average molecular weight of 9,500, a Tg of 55° C. and an acid value of 0.5 and a hydroxyl value of 49.

Next, 410 parts of the [intermediate polyester 1], 89 parts of isophoronediisocyanate and 500 parts of ethyl acetate were reacted in a reactor vessel including a cooling pipe, a stirrer and a nitrogen inlet pipe for 5 hrs at 100° C. to prepare a [prepolymer 1]. The [prepolymer 1] included a free isocyanate in an amount of 1.53% by weight.

[Synthesis of Ketimine]

170 parts of isophorondiamine and 75 parts of methyl ethyl ketone were reacted at 50° C. for 5 hrs in a reaction vessel including a stirrer and a thermometer to prepare a [ketimine compound 1]. The [ketimine compound 1] had an amine value of 418.

[Synthesis of Masterbatch]

40 parts of carbon black REGAL 400R from Cabot Corp., 60 parts of a binder resin, i.e., a polyester resin RS-801 having an acid value of 10, a Mw of 20,000 and a Tg of 64° C. and 30 parts of water were mixed by a HENSCHEL mixer to prepare a water-logged pigment agglomerate. This was kneaded by a two-roll mil having a surface temperature of 130° C. for 45 min, extended upon application of pressure, cooled and pulverized by a pulverizer to prepare a [masterbacth 1] having a particle diameter of 1 mm.

[Preparation of Oil Phase]

378 parts of the [low-molecular-weight polyester 1], 100 parts of carnauba wax and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the [masterbacth 1] and 500 parts of ethyl acetate were added to the mixture and mixed for 1 hr to prepare a [material solution 1].

1,324 parts of the [material solution 1] were transferred into another vessel, and the carbon black and wax therein were dispersed by a beads mill (Ultra visco Mill from IMECS CO., LTD.) for 3 passes under the following conditions:

liquid feeding speed of 1 kg/hr peripheral disc speed of 6 m/sec, and filling zirconia beads having diameter 0.5 mm for 80% by volume.

Next, 1,324 parts of an ethyl acetate solution of the [low-molecular-weight polyester 1] having a concentration of 65% were added to the [material solution 1] and the mixture was stirred by the beads mill for one pass under the same conditions to prepare a [pigment and wax dispersion liquid 1]. The [pigment and wax dispersion liquid 1] had a solid content concentration of 50%.

[Emulsification]

648 parts of the [pigment and wax dispersion liquid 1], 154 parts of the [prepolymer 1] and 6.6 parts of the [ketimine compound 1] were mixed in a vessel by a TK-type homomixer from Tokushu Kika Kogyo Co., Ltd. at 5,000 rpm for 1 min. 1,200 parts of the [aqueous phase 1] were added to the mixture and mixed by the TK-type homomixer at 13,000 rpm for 20 min to prepare an [emulsified slurry 1].

[Deformation]

1,000 parts of the [emulsified slurry 1] were mixed in an aqueous solution including 1,365 parts of ion-exchanged water and 35 parts carboxymethylcellulose CMC DAICEL-1280 from DAICEL CHEMICAL INDUSTRIES, LTD. by a TK-type homomixer from Tokushu Kika Kogyo Co., Ltd. at 2,000 rpm for 1 hr to prepare a [deformed slurry 1].

[De-Solvent]

The [deformed slurry 1] was put in a vessel including a stirrer and a thermometer, a solvent was removed therefrom at 30° C. for 8 hrs and the slurry was aged at 45° C. for 4 hrs to prepare a [dispersion slurry 1].

[Washing ⇒Drying]

After the [dispersion slurry 1] was filtered under reduced pressure to prepare a filtered cake, 100 parts of ion-exchanged water were added to the filtered cake and mixed by the TK-type homomixer at 12,000 rpm for 10 min, and the mixture was filtered.

Further, 100 parts of an aqueous solution of 10% sodium hydrate were added to the filtered cake and mixed by the TK-type homomixer at 12,000 rpm for 10 min upon application of ultrasonic vibration, and the mixture was filtered under reduced pressure. This ultrasonic alkaline washing was performed again (Two ultrasonic alkaline washings).

Further, 100 parts of 10% hydrochloric acid were added to the filtered cake and mixed by the TK-type homomixer at 12,000 rpm for 10 min, and the mixture was filtered.

Further, 300 parts of ion-exchange water were added to the filtered cake and mixed by the TK-type homomixer at 12,000 rpm for 10 min, and the mixture was filtered. This operation was repeated again to prepare a filtered cake 1. The filtered cake 1 was dried by an air drier at 45° C. for 48 hrs and sieved by a mesh having an opening of 75 μm to prepare parent toner particles 1.

Next, 100 parts of the parent toner particles 1 and 0.3 parts of charge controlling agent BONTRON E-84 from Orient Chemical Industries, Ltd. were mixed by a Q-type mixer from Mitsui Mining Co., Ltd., wherein a peripheral speed of a turbine blade thereof was 50 m/sec. This mixing operation included 5 cycles of 2 min mixing (total 10 min) and 1 min pausing.

Further, 0.5 parts of hydrophobic silica H2000 from Clariant (Japan) K.K. were mixed therein at a peripheral speed of 15 m/sec, which included 5 cycles of 30 sec mixing and 1 min pausing, to prepare a toner 1.

Low-Temperature Fixability

TYPE 6200 papers from Ricoh Company, Ltd. were set in a copier imagio NEO450 having a cleaning roller cleaning a pressure roller from Ricoh Company, Ltd., wherein a fixer is modified, to perform a copying test. The fixing roller temperature at which the image density was not less than 705 after scraped with a pad was a minimum fixable temperature. The required temperature is not greater than 170° C. The minimum fixable temperature not greater than 170° C. was ○. Greater than 170° C. was X.

Hot Offset Resistance

The fixing roller temperature at which the hot offset occurred was the hot offset temperature. The hot offset temperature not less than 220° C. was ○. Less than 220° C. was x .

Toner Melting

When the toner did not melt and contaminate the image even when 100,000 images were produced, ○; and when the toner melted and contaminated the image when 100,000 images were produced, X.

Image Quality

Defective transfer and image deterioration (specifically, background fouling) were comprehensively evaluated. A black solid image was produced to visually observe a defective transfer level thereof after 50,000 images were produced by imagio NEO450 from Ricoh Company, Ltd. While a blank image was developed, imagio NEO450 from Ricoh Company, Ltd. was turned off to transfer the developer on the photoreceptor after developed onto an adhesive tape after 50,000 images were produced thereby. A difference of image density between the adhesive tape and a brand-new adhesive tape was measured by 938 spectrodensitometer from X-Rite, Inc. Good image quality was ○, and defective image quality was X.

The toner 1 had a storage modulus G'1 of 5,600 before the reactive material is fed thereto, and a storage modulus G'2 of 9,100 after the reactive material is fed thereto. The difference was 3,500. The low-temperature fixability, hot offset resistance, image quality, toner melting of the toner 1 were all ○. The fixing roller had no damage.

This application claims priority and contains subject matter related to Japanese Patent Application Nos. 2004-272529 2004-272161, 2004-226198 and 2004-271385, filed on Sep. 17, 2004, Sep. 17, 2004, Aug. 2, 2004 and Sep. 17, 2004 respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A fixer fixing a toner comprising a binder resin and a colorant on a recording medium upon application of at least one of heat and pressure, comprising:

a fixing member configured to fix the toner on the recording medium;

a pressurizing member configured to pressurize the toner thereon;

a cleaning member configured to collect the toner from the fixing member or the pressurizing member onto the cleaning member; and a feeder configured to feed a reactive material to the cleaning member, wherein the reactive material is a material that reacts with the toner to increase the storage modulus of the toner on the cleaning member, wherein the reactive material is a metallic compound, wherein a storage modulus of the toner collected on the cleaning member is larger than a storage modulus thereof before fixed.

2. The fixer of claim 1, wherein the fixing member is a fixing roller and the pressurizing member is a pressure roller.

3. The fixer of claim 1, wherein the fixing member is a fixing belt extended and suspended on plural rollers, the pressurizing member is a pressure roller, and the cleaning member is a cleaning roller.

4. The fixer of claim 3, wherein the cleaning roller has a ten-point mean roughness Rz of from 3 to 50 μm.

5. The fixer of claim 3, wherein the cleaning roller is coated with a reactive material enlarging a storage modulus of the binder resin.

6. The fixer of claim 5, wherein the reactive material is a metallic compound.

7. The fixer of claim 1, wherein the toner has a storage modulus of from $5.0\times10^3$ to $5.0\times10^4$ Pa at 120° C. and a storage modulus of from $1.0\times10^3$ to $3.0\times10^4$ Pa at 180° C. before heated in the fixer.

8. The fixer of claim 1, wherein a difference between a storage modulus G'1 of the toner at 120° C. before a reactive material is fed thereto and a storage modulus G'2 thereof at 120° C. after the reactive material is fed thereto satisfies the following relationship:

$$0<G'2-G'1\leqq 10{,}000\ Pa.$$

9. The fixer of claim 1, wherein the toner collected on the cleaning member has a storage modulus at 120° C. of up to 100 times larger than a storage modulus at 120° C. thereof before being heated in the fixer.

10. The fixer of claim 1, wherein the toner collected on the cleaning member has a storage modulus at 180° C. of up to 10 times larger than a storage modulus at 180° C. thereof before being heated in the fixer.

11. The fixer of claim 1, wherein the binder resin comprises a polyester resin having an acid value of from 1.0 to 50.0 mg KOH/g.

12. The fixer of claim 1, wherein the toner comprises a charge controlling agent.

13. The fixer of claim 12, wherein the charge controlling agent is a salicylic acid metal complex included in the toner in an amount of from 0.5 to 6.0% by weight.

14. The fixer of claim 1, wherein the toner further comprises a release agent.

15. The fixer of claim 1, wherein the toner further comprises a metallic compound subjecting a prepolymer to an elongation or a crosslinking reaction upon receipt of heat.

16. The fixer of claim 15, wherein the metallic compound is a salicylic acid metal complex.

17. The fixer of claim 1, wherein the toner has an average circularity not less than 0.94.

18. The fixer of claim 1, wherein the toner is prepared by a method comprising:

dissolving or dispersing a polyester resin, a compound having an active hydrogen, a polymer having a group capable of reacting with the compound having an active hydrogen, a colorant and a release agent in an organic solvent to prepare a toner constituent; and dispersing the toner constituent in an aqueous medium to subject the toner constituent to at least one of an elongation reaction and a crosslinking reaction.

19. The fixer of claim 1, wherein the toner is prepared by a method comprising:

mixing and kneading a polyester resin, a compound having an active hydrogen, a polymer having a group capable of reacting with the compound having an active hydrogen, a colorant and a release agent upon application of heat to prepare a kneaded mixture; and cooling and pulverizing the kneaded mixture.

20. The fixer of claim 1, wherein the toner has a volume-average particle diameter (Dv) of from 3.0 to 8.0 μm, and a ratio (Dv/Dn) thereof to a number-average particle diameter (Dn) of from 1.00 to 1.40.

21. The fixer of claim 1, wherein the toner has a shape factor SF-1 of from 100 to 180 and a shape factor SF-2 of from 100 to 180.

22. The fixer of claim 1, wherein the toner has the shape of a spindle, and wherein a ratio ($r_2/r_1$) of a major axis particle diameter ($r_1$) of the toner to a minor axis particle diameter ($r_2$) thereof is from 0.5 to 1.0 and a ratio ($r_3/r_2$) of a thickness ($r_3$) of the toner to the minor axis particle diameter ($r_2$) thereof is from 0.7 to 1.0.

23. The fixer of claim 1, wherein the feeder is a feed roller.

24. The fixer of claim 1, wherein the cleaning member comprises a coated layer comprising:

a reactive material enlarging a storage modulus of the binder resin; and a coating resin, wherein the coated layer is plural.

25. The fixer of claim 24, wherein a ratio Dcore (the reactive material/the binder resin) at a contact part of the coated layer to a metallic shaft of the cleaning member and a ratio Dsurface (the reactive material/the binder resin) in the surface thereof satisfy the following relationship:

$$Dcore>Dsurface.$$

26. The fixer of claim 24, wherein the coated layer comprises at least:

a first coated layer located overlying the metallic shaft of the cleaning member; and a second coated layer located overlying the first coated layer, wherein the first coated layer includes the reactive material in a larger amount than the second coated layer per unit volume.

27. The fixer of claim 26, wherein the first coated layer includes the reactive material (RM) and the coating resin (CR) in an amount (RM/CR) of 30% to 70%/70% to 30% by weight.

28. The fixer of claim 24, wherein the coating resin has a functional group reacting with the reactive material at the end.

29. The fixer of claim 28, wherein the functional group is a carboxylic acid.

30. An image forming apparatus comprising:

an image bearer;

a charger configured to charge the image bearer;

an irradiator configured to irradiate the image bearer to form an electrostatic latent image thereon;

an image developer configured to develop the electrostatic latent image with a toner to form a toner image thereon;

a transferer configured to transfer the toner image onto a recording member;

a cleaner configured to remove the toner remaining on the image bearer; and a fixer configured to fix the toner image on the recording member, wherein the fixer is the fixer according to claim 1.

31. A process cartridge detachable from the image forming apparatus according to claim 30, comprising an image bearer; and at least one of a charger, an image developer and a cleaner.

* * * * *